US009091128B1

(12) United States Patent
Orgeron et al.

(10) Patent No.: US 9,091,128 B1
(45) Date of Patent: Jul. 28, 2015

(54) DRILL FLOOR MOUNTABLE AUTOMATED PIPE RACKING SYSTEM

(71) Applicant: T&T Engineering Services, Inc., Tomball, TX (US)

(72) Inventors: Keith J. Orgeron, Spring, TX (US); Darrell D. Jamison, Humble, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 16 days.

(21) Appl. No.: 13/681,244

(22) Filed: Nov. 19, 2012

Related U.S. Application Data

(60) Provisional application No. 61/561,817, filed on Nov. 18, 2011.

(51) Int. Cl.
*E21B 19/15* (2006.01)
*E21B 19/14* (2006.01)

(52) U.S. Cl.
CPC ..... *E21B 19/15* (2013.01); *E21B 19/14* (2013.01); *E21B 19/155* (2013.01)

(58) Field of Classification Search
USPC ..... 414/22.51–22.59, 22.61–22.69, 22.71, 414/728, 735, 742, 744.3, 744.4, 917
See application file for complete search history.

(56) References Cited

U.S. PATENT DOCUMENTS

| | | | |
|---|---|---|---|
| 62,404 | A | 2/1867 | Gile et al. |
| 184,168 | A | 11/1876 | Nickle |
| 364,077 | A | 5/1887 | Addis |
| 514,715 | A | 2/1894 | Jenkins |
| 1,175,792 | A | 3/1916 | Mickelsen |
| 1,264,867 | A | 4/1918 | Schuh |
| 1,312,009 | A | 8/1919 | Thrift |
| 1,318,789 | A | 10/1919 | Moschel |
| 1,369,165 | A | 2/1921 | Cochran et al. |
| 1,396,317 | A | 11/1921 | Boyter |
| 1,417,490 | A | 5/1922 | Brandon |

(Continued)

FOREIGN PATENT DOCUMENTS

| | | | |
|---|---|---|---|
| CA | 1247590 | A | 12/1988 |
| EP | 0 024 433 | A1 | 3/1981 |

(Continued)

OTHER PUBLICATIONS

U.S. Appl. No. 12/111,907, filed Apr. 29, 2008; non-published; titled "Pipe Gripping Apparatus" and having common inventors with the present patent application.

(Continued)

*Primary Examiner* — Gregory Adams
(74) *Attorney, Agent, or Firm* — John G. Fischer, Esq.; Jaspal S. Hare, Esq.; Scheef & Stone, L.L.P.

(57) ABSTRACT

The present invention relates to an apparatus and method for use in subterranean exploration, and provides a rapid rig-up and rig-down pipe racking system that is capable of being retrofit to an existing drilling rig. In particular, the invention relates to a pipe drill floor mounted pipe racking system that is capable of controlled movement of pipe in three dimensions, and most importantly, capable of rapid and precise movement of multiple connected sections of pipe. The invention is capable of moving stands of connected pipe from a racked position on the drill floor to an accurate stabbing position directly above a drill string component held in a rotary table.

29 Claims, 21 Drawing Sheets

(56) References Cited

U.S. PATENT DOCUMENTS

| | | | | | |
|---|---|---|---|---|---|
| 1,483,037 | A | | 2/1924 | Zallinger | |
| 1,768,861 | A | | 7/1930 | Richards | |
| 1,972,635 | A | | 9/1934 | Whinnen | |
| 1,981,304 | A | | 11/1934 | Brandt | |
| 2,124,154 | A | | 7/1937 | Sovincz | |
| 2,147,002 | A | | 2/1939 | Volpin | |
| 2,327,461 | A | | 8/1943 | Rowe | |
| 2,328,197 | A | | 8/1943 | Cowin | |
| 2,369,534 | A | | 2/1945 | Cohen | |
| 2,382,767 | A | | 8/1945 | Zeilman | |
| 2,476,210 | A | | 7/1949 | Moore | |
| 2,497,083 | A | | 2/1950 | Hildebrand | |
| 2,509,853 | A | | 5/1950 | Wilson | |
| 2,535,054 | A | | 12/1950 | Ernst et al. | |
| 2,595,307 | A | | 5/1952 | Selberg | |
| 2,592,168 | A | | 8/1952 | Morris et al. | |
| 2,710,431 | A | | 6/1955 | Griffon | |
| 2,715,014 | A | | 8/1955 | Garnett et al. | |
| 2,770,493 | A | | 11/1956 | Fieber | |
| 2,814,396 | A | | 11/1957 | Neal, Sr. | |
| 2,828,024 | A | | 3/1958 | True | |
| 2,840,244 | A | | 6/1958 | Thomas, Jr. | |
| 2,937,726 | A | | 5/1960 | Manfred et al. | |
| 3,016,992 | A | | 1/1962 | Wilson | |
| 3,033,529 | A | | 5/1962 | Pierrat | |
| 3,059,905 | A | | 10/1962 | Tompkins | |
| 3,076,560 | A | | 2/1963 | Bushong et al. | |
| 3,136,394 | A | | 6/1964 | Woolslayer et al. | |
| 3,177,944 | A | | 4/1965 | Knights | |
| 3,180,496 | A | | 4/1965 | Smith | |
| 3,194,313 | A | | 7/1965 | Fanshawe | |
| 3,262,593 | A | * | 7/1966 | Hainer | 414/619 |
| 3,280,920 | A | | 10/1966 | Scott | |
| 3,290,006 | A | | 12/1966 | Dubberke | |
| 3,331,585 | A | | 7/1967 | Dubberke | |
| 3,365,762 | A | | 1/1968 | Spiri | |
| 3,421,269 | A | | 1/1969 | Medow | |
| 3,425,322 | A | | 2/1969 | Zucchellini | |
| 3,432,159 | A | | 3/1969 | Rakatansky | |
| 3,464,507 | A | | 9/1969 | Alexander et al. | |
| 3,477,522 | A | | 11/1969 | Templeton | |
| 3,498,375 | A | | 3/1970 | McEwen et al. | |
| 3,559,821 | A | | 2/1971 | James | |
| 3,561,811 | A | | 2/1971 | Turner, Jr. | |
| 3,633,466 | A | | 1/1972 | Field | |
| 3,633,771 | A | | 1/1972 | Woolslayer et al. | |
| 3,675,303 | A | | 7/1972 | McKinnon | |
| 3,682,259 | A | | 8/1972 | Cintract et al. | |
| 3,702,640 | A | | 11/1972 | Cintract et al. | |
| 3,703,968 | A | | 11/1972 | Uhrich et al. | |
| 3,706,347 | A | | 12/1972 | Brown | |
| 3,734,208 | A | * | 5/1973 | Otto | 175/52 |
| 3,774,781 | A | | 11/1973 | Merkley | |
| 3,792,783 | A | | 2/1974 | Brown | |
| 3,797,672 | A | | 3/1974 | Vermette | |
| 3,804,264 | A | | 4/1974 | Hedeen et al. | |
| 3,805,463 | A | | 4/1974 | Lang et al. | |
| 3,806,021 | A | | 4/1974 | Moroz et al. | |
| 3,823,916 | A | | 7/1974 | Shaw | |
| 3,848,850 | A | | 11/1974 | Bemis | |
| 3,860,122 | A | | 1/1975 | Cernosek | |
| 3,883,009 | A | | 5/1975 | Swoboda, Jr. et al. | |
| 3,942,593 | A | | 3/1976 | Reeve, Jr. et al. | |
| 3,963,133 | A | | 6/1976 | Gilli | |
| 3,986,619 | A | | 10/1976 | Woolslayer et al. | |
| 3,991,887 | A | | 11/1976 | Trout | |
| 3,995,746 | A | | 12/1976 | Usagida | |
| 4,011,694 | A | | 3/1977 | Langford | |
| 4,030,698 | A | | 6/1977 | Hansen | |
| 4,044,952 | A | | 8/1977 | Williams et al. | |
| 4,135,340 | A | | 1/1979 | Cox et al. | |
| 4,138,805 | A | | 2/1979 | Patterson | |
| 4,142,551 | A | | 3/1979 | Wilms | |
| 4,158,283 | A | | 6/1979 | Nation | |
| 4,172,684 | A | | 10/1979 | Jenkins | |
| 4,201,022 | A | | 5/1980 | Jennings | |
| 4,221,269 | A | | 9/1980 | Hudson | |
| 4,226,167 | A | | 10/1980 | Lew | |
| 4,269,554 | A | | 5/1981 | Jackson | |
| 4,276,918 | A | | 7/1981 | Sigouin | |
| 4,277,044 | A | | 7/1981 | Hamilton | |
| 4,290,495 | A | | 9/1981 | Elliston | |
| 4,303,270 | A | | 12/1981 | Adair | |
| 4,336,840 | A | | 6/1982 | Bailey | |
| 4,338,965 | A | | 7/1982 | Garnjost et al. | |
| 4,359,089 | A | | 11/1982 | Strate et al. | |
| 4,383,455 | A | | 5/1983 | Tuda et al. | |
| 4,386,883 | A | | 6/1983 | Hogan et al. | |
| 4,403,666 | A | | 9/1983 | Willis | |
| 4,403,897 | A | | 9/1983 | Willis | |
| 4,403,898 | A | | 9/1983 | Thompson | |
| 4,407,629 | A | | 10/1983 | Willis | |
| 4,420,917 | A | | 12/1983 | Parlanti | |
| 4,426,182 | A | | 1/1984 | Frias et al. | |
| 4,440,536 | A | | 4/1984 | Scaggs | |
| 4,492,501 | A | | 1/1985 | Haney | |
| 4,529,094 | A | | 7/1985 | Wadsworth | |
| 4,547,110 | A | | 10/1985 | Davidson et al. | |
| 4,586,572 | A | | 5/1986 | Myers et al. | |
| 4,595,066 | A | | 6/1986 | Nelmark et al. | |
| 4,598,509 | A | | 7/1986 | Woolslayer et al. | |
| 4,604,724 | A | | 8/1986 | Shaginian et al. | |
| 4,605,077 | A | | 8/1986 | Boyadjieff | |
| 4,650,237 | A | | 3/1987 | Lessway | |
| 4,658,970 | A | | 4/1987 | Oliphant | |
| 4,681,172 | A | | 7/1987 | Mikiya et al. | |
| 4,688,983 | A | | 8/1987 | Lindbom | |
| 4,708,581 | A | | 11/1987 | Adair | |
| 4,756,204 | A | | 7/1988 | Wittwer et al. | |
| 4,759,414 | A | | 7/1988 | Willis | |
| 4,765,225 | A | | 8/1988 | Birchard | |
| 4,765,401 | A | | 8/1988 | Boyadjieff | |
| 4,767,100 | A | | 8/1988 | Philpot | |
| 4,821,816 | A | | 4/1989 | Willis | |
| 4,822,230 | A | | 4/1989 | Slettedal | |
| 4,834,604 | A | | 5/1989 | Brittain et al. | |
| 4,837,992 | A | | 6/1989 | Hashimoto | |
| 4,869,137 | A | | 9/1989 | Slator | |
| 4,982,853 | A | | 1/1991 | Kishi | |
| 5,060,762 | A | | 10/1991 | White | |
| 5,121,793 | A | | 6/1992 | Busch et al. | |
| 5,135,119 | A | | 8/1992 | Larkin | |
| 5,150,642 | A | | 9/1992 | Moody et al. | |
| 5,186,264 | A | | 2/1993 | du Chaffaut | |
| 5,255,751 | A | | 10/1993 | Stogner | |
| 5,415,057 | A | | 5/1995 | Nihei et al. | |
| 5,423,390 | A | * | 6/1995 | Donnally et al. | 175/85 |
| 5,458,454 | A | | 10/1995 | Sorokan | |
| 5,481,959 | A | | 1/1996 | Watanabe et al. | |
| 5,486,084 | A | * | 1/1996 | Pitman et al. | 414/694 |
| 5,595,248 | A | | 1/1997 | Denny | |
| 5,597,987 | A | | 1/1997 | Gilliland et al. | |
| 5,609,226 | A | | 3/1997 | Penisson | |
| 5,609,260 | A | | 3/1997 | Liao | |
| 5,609,457 | A | | 3/1997 | Burns | |
| 5,649,745 | A | | 7/1997 | Anderson | |
| 5,660,087 | A | | 8/1997 | Rae | |
| 5,671,932 | A | | 9/1997 | Chapman | |
| 5,702,139 | A | | 12/1997 | Buck | |
| 5,806,589 | A | | 9/1998 | Lang | |
| 5,816,565 | A | | 10/1998 | McGuffin | |
| 5,848,647 | A | | 12/1998 | Webre et al. | |
| 5,915,673 | A | | 6/1999 | Kazerooni | |
| 5,931,238 | A | | 8/1999 | Gilmore et al. | |
| 5,934,028 | A | | 8/1999 | Taylor | |
| 5,957,431 | A | | 9/1999 | Serda, Jr. | |
| 5,964,550 | A | | 10/1999 | Blandford et al. | |
| 5,988,299 | A | | 11/1999 | Hansen et al. | |
| 5,992,801 | A | | 11/1999 | Torres | |
| 5,993,140 | A | | 11/1999 | Crippa | |
| 6,003,598 | A | | 12/1999 | Andreychuk | |
| 6,053,255 | A | | 4/2000 | Crain | |
| 6,079,490 | A | | 6/2000 | Newman | |
| 6,079,925 | A | | 6/2000 | Morgan et al. | |

(56) References Cited

U.S. PATENT DOCUMENTS

| | | | | |
|---|---|---|---|---|
| 6,158,516 | A | 12/2000 | Smith et al. | |
| 6,220,807 | B1 | 4/2001 | Sorokan | |
| 6,227,587 | B1 | 5/2001 | Terral | |
| 6,234,253 | B1 | 5/2001 | Dallas | |
| 6,237,445 | B1 | 5/2001 | Wesch, Jr. | |
| 6,253,845 | B1 | 7/2001 | Belik | |
| 6,263,763 | B1 | 7/2001 | Feigel, Jr. et al. | |
| 6,264,128 | B1 | 7/2001 | Shampine et al. | |
| 6,264,395 | B1 | 7/2001 | Allamon et al. | |
| 6,276,450 | B1 | 8/2001 | Seneviratne | |
| 6,279,662 | B1 | 8/2001 | Sonnier | |
| 6,298,928 | B1 | 10/2001 | Penchansky | |
| 6,311,788 | B1 | 11/2001 | Weixler | |
| 6,343,892 | B1 | 2/2002 | Kristiansen | |
| 6,398,186 | B1 | 6/2002 | Lemoine | |
| 6,431,286 | B1 | 8/2002 | Andreychuk | |
| 6,471,439 | B2 | 10/2002 | Allamon et al. | |
| 6,502,641 | B1 | 1/2003 | Carriere et al. | |
| 6,524,049 | B1 | 2/2003 | Minnes | |
| 6,533,045 | B1 | 3/2003 | Cooper | |
| 6,543,551 | B1 | 4/2003 | Sparks et al. | |
| 6,543,555 | B2 | 4/2003 | Casagrande | |
| 6,550,128 | B1 * | 4/2003 | Lorenz | 29/464 |
| 6,557,641 | B2 | 5/2003 | Mosing et al. | |
| 6,564,667 | B2 | 5/2003 | Bayer et al. | |
| 6,581,698 | B1 | 6/2003 | Dirks | |
| 6,609,573 | B1 | 8/2003 | Day | |
| 6,705,414 | B2 | 3/2004 | Simpson et al. | |
| 6,745,646 | B1 | 6/2004 | Pietras et al. | |
| 6,748,823 | B2 | 6/2004 | Pietras | |
| 6,763,898 | B1 | 7/2004 | Roodenburg et al. | |
| 6,779,614 | B2 | 8/2004 | Oser | |
| 6,814,149 | B2 | 11/2004 | Liess et al. | |
| 6,845,814 | B2 | 1/2005 | Mason et al. | |
| 6,854,520 | B1 | 2/2005 | Robichaux | |
| 6,969,223 | B2 | 11/2005 | Tolmon et al. | |
| 7,021,880 | B2 | 4/2006 | Morelli et al. | |
| 7,028,585 | B2 | 4/2006 | Pietras et al. | |
| 7,036,202 | B2 | 5/2006 | Lorenz | |
| 7,044,315 | B2 | 5/2006 | Willim | |
| 7,055,594 | B1 | 6/2006 | Springett et al. | |
| 7,077,209 | B2 | 7/2006 | McCulloch et al. | |
| 7,090,035 | B2 | 8/2006 | Lesko | |
| 7,090,254 | B1 | 8/2006 | Pietras et al. | |
| 7,117,938 | B2 | 10/2006 | Hamilton et al. | |
| 7,121,166 | B2 | 10/2006 | Drzewiecki | |
| 7,172,038 | B2 | 2/2007 | Terry et al. | |
| 7,246,983 | B2 | 7/2007 | Zahn et al. | |
| 7,249,639 | B2 | 7/2007 | Belik | |
| 7,289,871 | B2 | 10/2007 | Williams | |
| 7,296,623 | B2 | 11/2007 | Koithan et al. | |
| 7,331,746 | B2 | 2/2008 | Wright et al. | |
| 7,398,833 | B2 | 7/2008 | Ramey et al. | |
| 7,438,127 | B2 | 10/2008 | Lesko | |
| 7,452,177 | B2 * | 11/2008 | Gokita | 414/694 |
| 7,503,394 | B2 | 3/2009 | Bouligny | |
| 7,513,312 | B2 | 4/2009 | Carriere et al. | |
| 7,726,929 | B1 | 6/2010 | Orgeron | |
| 7,794,192 | B2 * | 9/2010 | Wright et al. | 414/22.65 |
| 7,841,415 | B2 * | 11/2010 | Winter | 166/382 |
| 7,918,636 | B1 | 4/2011 | Orgeron | |
| 7,980,802 | B2 | 7/2011 | Orgeron | |
| 8,172,497 | B2 | 5/2012 | Orgeron et al. | |
| 8,192,128 | B2 | 6/2012 | Orgeron | |
| 8,192,129 | B1 | 6/2012 | Orgeron | |
| 8,506,229 | B2 | 8/2013 | Orgeron | |
| 8,876,452 | B2 | 11/2014 | Orgeron et al. | |
| 8,905,699 | B2 | 12/2014 | Orgeron | |
| 2002/0070187 | A1 | 6/2002 | Willim | |
| 2002/0079105 | A1 | 6/2002 | Bergeron | |
| 2003/0170095 | A1 | 9/2003 | Slettedal | |
| 2003/0221871 | A1 | 12/2003 | Hamilton et al. | |
| 2005/0269133 | A1 | 12/2005 | Little | |
| 2006/0027793 | A1 | 2/2006 | Kysely | |
| 2006/0045654 | A1 | 3/2006 | Guidroz | |
| 2006/0104747 | A1 | 5/2006 | Zahn et al. | |
| 2006/0113073 | A1 | 6/2006 | Wright et al. | |
| 2008/0174131 | A1 | 7/2008 | Bouligny et al. | |
| 2008/0202812 | A1 | 8/2008 | Childers et al. | |
| 2008/0253866 | A1 | 10/2008 | Lops et al. | |
| 2009/0257848 | A1 | 10/2009 | Stroshein et al. | |
| 2009/0279987 | A1 | 11/2009 | Jantzen | |
| 2010/0034620 | A1 * | 2/2010 | Orgeron | 414/22.55 |
| 2010/0104401 | A1 * | 4/2010 | Hopkins et al. | 414/22.54 |
| 2010/0329823 | A1 | 12/2010 | Baumler et al. | |
| 2011/0079434 | A1 | 4/2011 | Belik et al. | |
| 2012/0118639 | A1 | 5/2012 | Gerber | |
| 2012/0167485 | A1 | 7/2012 | Trevithick et al. | |

FOREIGN PATENT DOCUMENTS

| | | | | |
|---|---|---|---|---|
| EP | 0192452 | A1 | 8/1986 | |
| EP | 1752608 | A2 | 2/2007 | |
| EP | 1980709 | A1 * | 10/2008 | E21B 7/20 |
| GB | 727780 | | 4/1955 | |
| JP | 05-044385 | A | 2/1993 | |
| WO | 93/15303 | A1 | 8/1993 | |
| WO | WO 2004018829 | A1 * | 3/2004 | E21B 19/15 |
| WO | 2006/038790 | A1 | 4/2006 | |
| WO | WO 2008034262 | A1 * | 3/2008 | E21B 19/16 |
| WO | 2009/055590 | A2 | 4/2009 | |
| WO | WO 2011120627 | A2 * | 10/2011 | |

OTHER PUBLICATIONS

Chronis, Nicholas P., Mechanisms & Mechanical Devices Sourcebook, 1991, Ch. 10, pp. 399-414, ISBN 0-07-010918-4, McGraw-Hill, Inc.

* cited by examiner

DRILL FLOOR MOUNTABLE AUTOMATED PIPE RACKING SYSTEM

TECHNICAL FIELD OF INVENTION

The present invention relates to an apparatus and method for use in subterranean exploration. The present invention provides a rapid rig-up and rig-down pipe racking system that is capable of being retrofit to an existing drilling rig. In particular, the invention relates to a pipe drill floor mounted pipe racking system that is capable of controlled movement of pipe in three dimensions, and most importantly, capable of rapid and precise movement of multiple connected sections of pipe. The invention is capable of moving stands of connected pipe from a racked position on the drill floor to an accurate stabbing position directly above a drill string component held in a rotary table.

BACKGROUND OF THE INVENTION

In the exploration of oil, gas and geothermal energy, drilling operations are used to create boreholes, or wells, in the earth. Subterranean drilling necessarily involves the movement of long lengths of tubular sections of pipe. At various intervals in the drilling operation, all of the drill pipe must be removed from the wellbore. This most commonly occurs when a drill bit wears out, requiring a new drill bit to be located at the end of the drill string. It can also be necessary to reconfigure the bottom-hole assembly or replace other downhole equipment that has otherwise failed. When the drill pipe has to be removed, it is disconnected at every second or third connection, depending on the height of the mast. On smaller drilling rigs used in shallower drilling, every other connection is disconnected, and two lengths of drill pipe, known as "doubles" are lifted off of the drill string, aligned in the fingers of the rack by the derrickman, and then lowered onto the drill floor away from the well center. On larger drilling rigs used for deeper drilling, every third connection is disconnected and three lengths of drill pipe, known as "triples" are lifted off of the drill string, aligned in the fingers of the rack by the derrickman, and then lowered onto the drill floor away from the well center. The doubles and triples are called a stand of pipe. The stands are stored vertically on the rig floor, aligned neatly between the fingers of the rack on the mast.

Removing all of the drill pipe from the well and then reconnecting it to run back into the well is known as "tripping the pipe" or "making a trip," since the drill bit is making a round trip from the bottom of the hole to the surface and then back to the bottom of the hole. Tripping the drill pipe is a very expensive and dangerous operation for a drilling rig. Most injuries that occur on a drilling rig are related to tripping the pipe. Additionally, the wellbore is making no progress while the pipe is being tripped, so it is downtime that is undesirable. This is why quality drill bits are critical to a successful drill bit operation. Drill bits that fail prematurely can add significant cost to a drilling operation. Since tripping pipe is "non-drilling time," it is desirable to complete the trip as quickly as possible. Most crews are expected to move the pipe as quickly as possible. The pipe stands are long and thin (about ninety feet long).

There are a number of variables that contribute to irregular and hostile movement of the pipe stand as it is disconnected and moved to the rack for setting on the drill floor, as well as when it is being picked up for alignment over the wellbore center for stabbing and connection to the drill string in the wellbore. For example, the vertical alignment and travel of the elevator and hoist connection which lift the drill string from the wellbore is cable connected, and capable of lateral movement which is translated to the drill string rising from the wellbore. Also, the drill string is supported from the top, and as the derrickman moves the drill string laterally, the accelerated lateral movement of the long length of the pipe stand away from the well center generates a wave form movement in the pipe itself. As a result of the natural and hostile movement of the heavy drill stand, which typically weighs between 1,500 and 2,000 lbs., and drill collars which weigh up to 20,000 lbs., it is necessary for crew members to stabilize the drill pipe manually by physically wrestling the pipe into position. The activity also requires experienced and coordinated movement between the driller operating the drawworks and the derrickman and floorhands. Needless to say, many things can and do go wrong in this process, which is why tripping pipe and pipe racking is a primary safety issue in a drilling operation.

Attempts have been made to mechanize all or part of the pipe racking operation. On offshore platforms, where funding is justifiable and where drill floor space is available, large Cartesian racking systems have been employed, in which the pipe stands are gripped at upper and lower positions to add stabilization, and tracked modules at the top and bottom of the pipe stand coordinate the movement of the pipe stand from the wellbore center to a racked position. Such systems are very large and very expensive, and are not suitable for use on a traditional land based drilling rig.

A previous attempt to mechanize pipe racking on conventional land based drilling rigs is known as the Iron Derrickman® pipe-handling system. The apparatus is attached high in the mast, at the rack board, and relies on a system of hydraulics to lift and move stands of drill pipe and collars from the hole center to programmed coordinates in the racking board. This cantilever mast mounted system has a relatively low vertical load limit, and therefore requires assistance of the top drive when handling larger diameter collars and heavy weight collars.

The movement of the pipe with this system is somewhat unpredictable and requires significant experience to control. It grasps the pipe from above the center of gravity of the tubular and fails to control the hostile movement of the pipe stand sufficiently to allow for safe handling of the stands or for timely movement without the intervention of drilling crew members. In particular, the system is not capable for aligning the lower free end of the drill stand accurately for stabbing into the drill string in the wellbore. As a result of these and other deficiencies, the system has had limited acceptance in the drilling industry.

An alternative system that is known provides vertical lifting capacity from the top drive and a lateral movement only guidance system located near the rack. The system still requires a floorman for stabbing the pipe to the stump as well as to the set-back position.

A primary difficulty in mechanizing pipe stand racking is the hostile movement of the pipe that is generated by stored energy in the stand, misaligned vertical movement, and the lateral acceleration and resultant bending and oscillation of the pipe, which combine to generate hostile and often unpredictable movements of the pipe, making it hard to position, and extremely difficult to stab.

A conflicting difficulty in mechanizing pipe stand racking is the need to move the pipe with sufficient rapidity that cost savings are obtained over the cost of manual manipulation by an experienced drilling crew. The greater accelerations required for rapid movement store greater amounts of energy in the pipe stand, and greater attenuated movement of the stand.

Another primary obstacle in mechanizing pipe stand racking is the prediction and controlled management of the pipe stand movement sufficient to permit the precise alignment required for stabbing the pipe to a first target location on the drill floor and to a second target location within the fingers of the racking board.

An even greater obstacle in mechanizing pipe stand racking is the prediction and controlled management of the pipe stand movement sufficient to achieve the precise alignment required for stabbing the tool joint of the tubular held by the racking mechanism into the receiving tubular tool joint connection extending above the wellbore and drill floor.

Another obstacle to land-based mechanizing pipe stand racking is the lack of drilling floor space to accommodate a railed system like those that can be used on large offshore drilling rigs.

Another obstacle to mechanizing pipe stand racking is the several structural constraints that are presented by the thousands of existing conventional drilling rigs, where the need to retrofit is constrained to available space and structure. For example, existing structures require orthogonal movement of the drill stand over a significant distance and along narrow pathways for movement.

Another obstacle to mechanizing pipe stand racking is the need to provide a reliable mechanized solution that is also affordable for retrofit to a conventional drilling rig. Still another obstacle to mechanizing pipe stand racking is the need to grip and lift pipe stands within the narrow confines of parallel rows of pipe stands in a conventional rack.

It is also desirable to minimize accessory structure and equipment, particularly structure and equipment that may interfere with transportation or with manpower movement and access to the rig floor during drilling operations. It is further desirable to ergonomically limit the manpower interactions with rig components during rig-up for cost, safety and convenience.

Thus, technological and economic barriers have prevented the development of a pipe racking system capable of achieving these goals. Conventional prior art drilling rig configurations remain manpower and equipment intensive to trip pipe and rack pipe when tripping. Alternative designs have failed to meet the economic and reliability requirements necessary to achieve commercial application. In particular, prior art designs fail to control the natural attenuation of the pipe and fail to position the pipe with sufficient rapidity and accuracy.

A goal of the racker invention is to achieve rapid and accurate unmanned movement of the pipe between the racked position and the over-well position. Thus, the racker must avoid storage of energy within the positioning structure. True verticality is critical to limiting the energy storage of the system. Additionally, controlled movement and positional holding of the stand is critical to allowing rapid movement by adding the stiffness to the system.

In summary, the various embodiments of the present invention provide a unique solution to the problems arising from a series of overlapping design constraints, including limited drill floor space, and obtaining sufficient stiffness from a retrofittable assembly to provide a controlled and precise automated movement and racking of drill pipe. More specifically, the various embodiments of the present invention provide for lateral movement of the pipe stand independent of assistance from the top drive, and without extension and retraction of the top drive for handing the pipe stand to the racking system. This provides free time for the top drive to move with the racker system in positioning the pipe without assistance from the top drive. Additionally, the various embodiments of the present invention provide a device capable of precise and accurate stabbing of the drill stand, resulting in faster trip time.

SUMMARY OF THE INVENTION

The present invention provides a new and novel pipe stand racking system and method of use. In one embodiment, an automatic pipe racker is provided, having a base frame connectable to a drill floor of a drill rig and extending upwards at a position offset to a V-door side of a drilling mast that is also connected to the drill floor. In one embodiment, the base frame is a C-frame design. A mast brace may be connected between the base frame and the drilling mast at a position distal to the drill floor for stabilizing an upper end of the base frame in relationship to the mast. A tensioning member may be connected between the base frame and the drilling floor for stabilizing the base frame in relationship to the substructure.

A lateral extend mechanism is pivotally connectable to the base frame. The lateral extend mechanism is extendable between a retracted position and a deployed position. A rotate mechanism is interconnected to the lateral extend mechanism and is rotatable in each of the left and right directions. A finger extend mechanism is connected to the rotate mechanism. The finger extend mechanism is laterally extendable between a retracted position and a deployed position.

A vertical grip and stab mechanism is attached to the finger extend mechanism. The grip and stab mechanism has grippers to hold a tubular or stand of pipe and is capable of moving the pipe vertically to facilitate stabbing. The lateral extend mechanism is deployable to move the rotating finger extend mechanism and grip and stab mechanism between a position beneath a racking board cantilevered from the mast and a position substantially beneath the mast.

In another embodiment, movement of the lateral extend mechanism between the retracted position and the deployed position moves the rotate mechanism along a substantially linear path. In a more preferred embodiment, movement of the lateral extend mechanism between the retracted position and the deployed position moves the rotate mechanism along a substantially horizontal path.

The rotate mechanism is rotatable in each of a left and right direction. In a more preferred embodiment, the rotate mechanism is rotatable in each of a left and right direction by at least ninety degrees. In another preferred embodiment, the pipe stand gripping mechanism is vertically translatable to vertically raise and lower the load of a stand of pipe.

In another embodiment, the automatic pipe racking system is series nesting. In this embodiment, the finger extend mechanism and grip and stab mechanism are substantially retractable into the rotate mechanism, which is substantially retractable into the pivot frame of the lateral extend mechanism, which is substantially retractable into the base frame.

As will be understood by one of ordinary skill in the art, the sequence of the steps disclosed may be modified and the same advantageous result obtained. For example, the wings may be deployed before connecting the lower mast section to the drill floor (or drill floor framework).

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
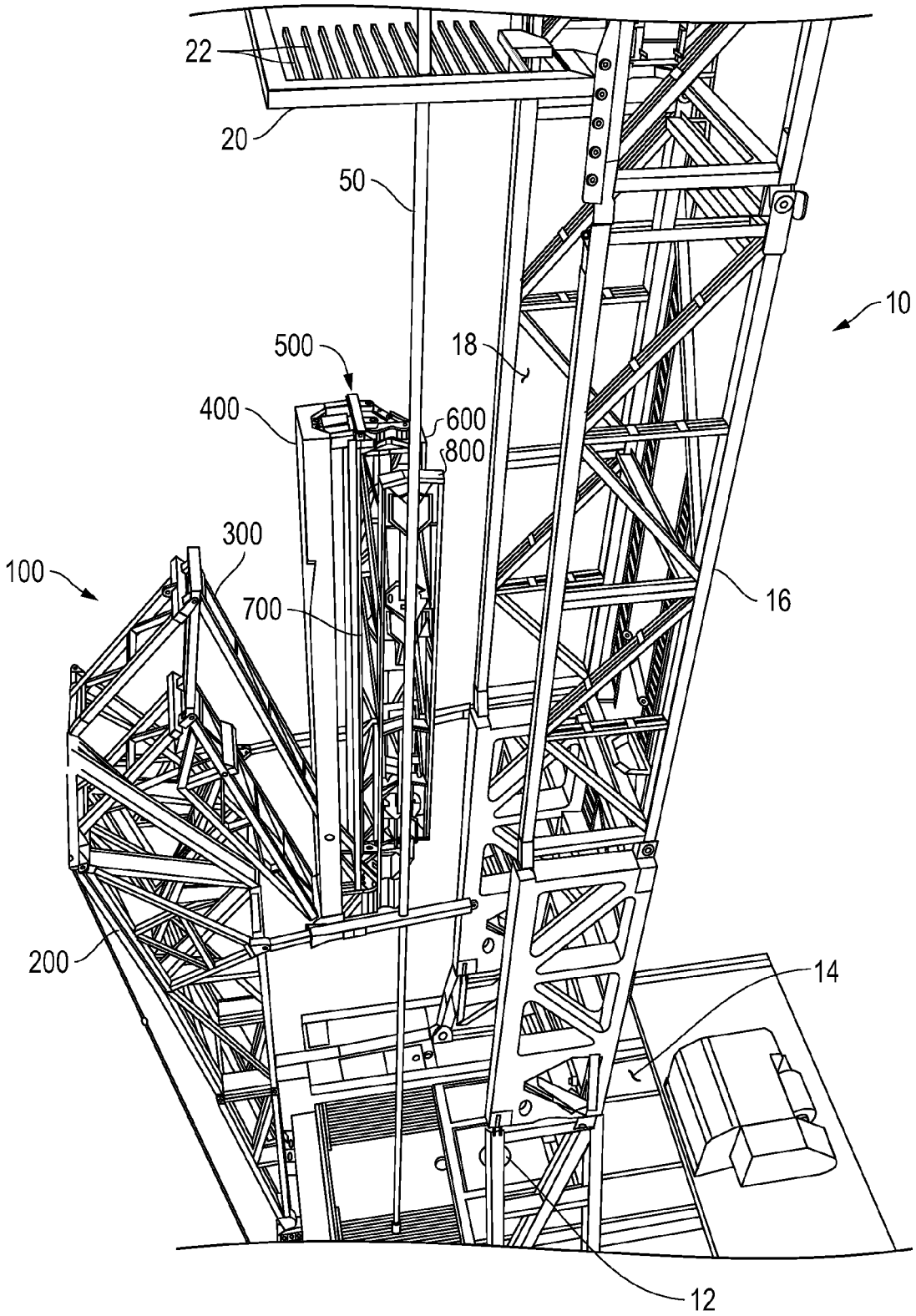
FIG. 1 is an isometric view of a drilling rig fitted with an automatic pipe racking system having features in accordance with embodiments of the present invention.

FIG. 1 is an isometric view of a racking mechanism 100 including features of the invention. As seen in FIG. 1, a drilling rig 10 is located over a wellbore 12. Drilling rig 10 has a drill floor 14 and a drilling mast 16 extending upwards above drill floor 14 and located over wellbore 12. Drilling mast 16 has an open V-door side 18. A racking board 20 extends horizontally outward on V-door side 18. Racking board 20 has a plurality of fingers 22 extending horizontally for supporting drill pipe 50 when it is removed from wellbore 12. Automatic racker 100 is mounted to drill floor 14, on V-door side 18 of drilling mast 16. Other features and components of automatic racker 100 can be seen illustrated in FIG. 1, and will be discussed in the paragraphs below.

Figure 2:
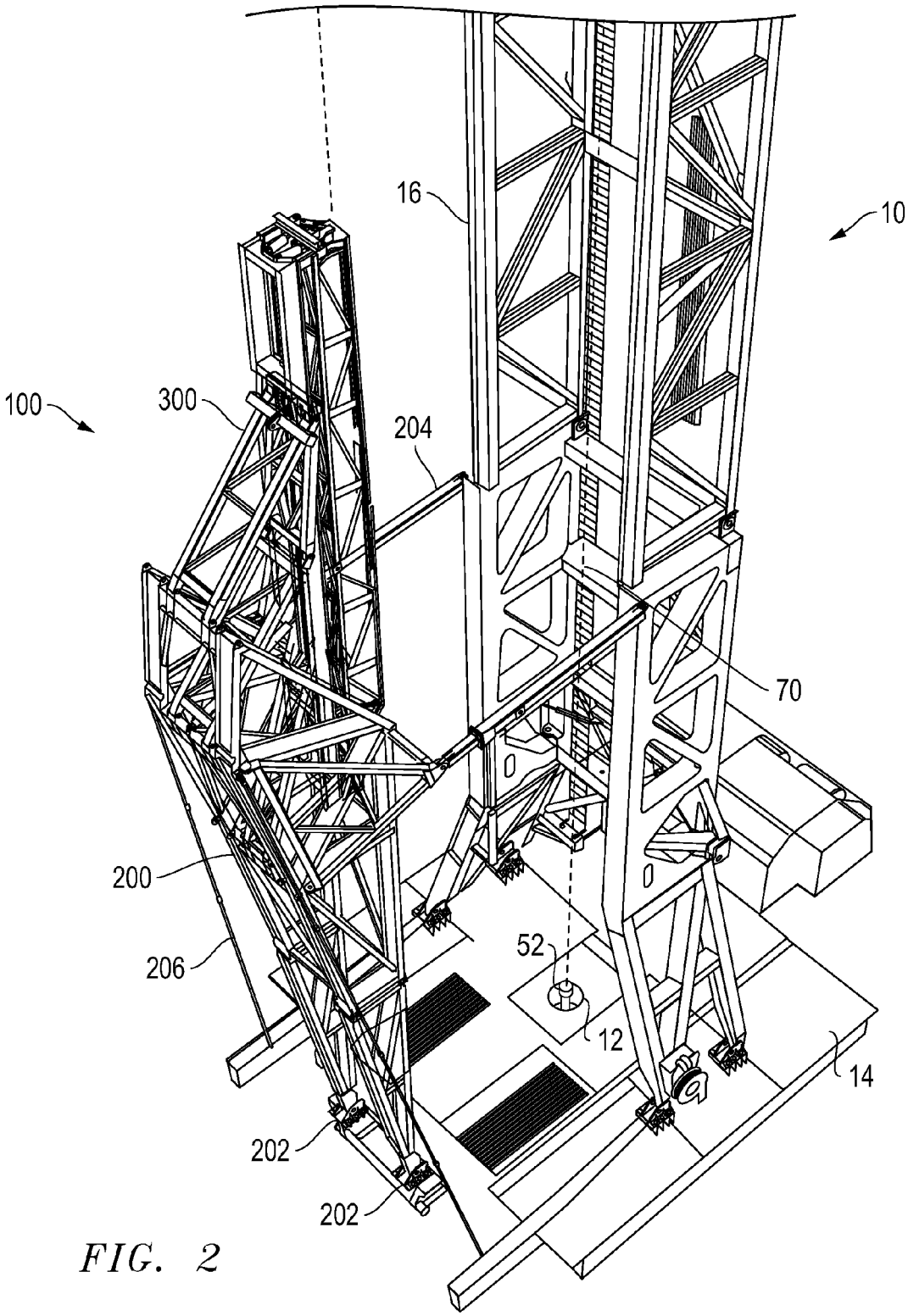
FIG. 2 is an isometric view of the racking mechanism illustrating the mechanism fully retracted within the base frame.

FIG. 2 is an isometric view of racking mechanism 100 in accordance with one embodiment of the invention, illustrating racking mechanism 100 in the fully retracted position. Racking mechanism 100 is comprised of a base frame 200 that is connected to drill floor 14 by floor pins 202. In one embodiment, base frame 200 is a tapered C-frame that extends upwards from drill floor 14 at a position offset to V-door side 18 of drilling mast 16. A mast brace 204 is connected between base frame 200 and drilling mast 16 at a position distal to drill floor 14 for stabilizing an upper end of base frame 200 in relationship to drilling mast 16. In one embodiment, a pair of tensioning members 206 is connected between drill floor 14 and base frame 200. Tensioning members 206 provide further support and stability to the base frame 200 with respect to the drill floor 14.

In one embodiment, base frame 200 comprises a pair of deployable wings 208 (not shown), pivotally attached to base frame 200. When wings 208 are deployed outward, deployed ends of wings 208 are connected to base frame 200 by struts 210 (not shown). In this embodiment, mast braces 204 are connected to the deployed ends of wings 208, increasing the spacing between mast braces 204 to facilitate conflict free operation of racking mechanism 100. Retraction of wings 208 provides a narrower transport profile for transporting racking mechanism 100 between drilling sites.

As seen in FIG. 2, wellbore 12 has a vertical well centerline 70 that extends through and above the entrance of wellbore 12. Well centerline 70 represents the theoretical target location for stabbing drill pipe 50. Mast brace 204 stabilizes an upper end of base frame 200 in relationship to drilling mast 16. In a preferred embodiment, the length of mast brace 204 is adjustable to compensate for deflection of racking mechanism 100 under different payloads which vary with the size of the tubular being handled. Adjustment is also advantageous to accommodate non-verticality and settling of drilling rig 10. Adjustment is also useful for connectivity to other mechanisms that deliver or receive pipe from racking mechanism 100.

Figure 3:
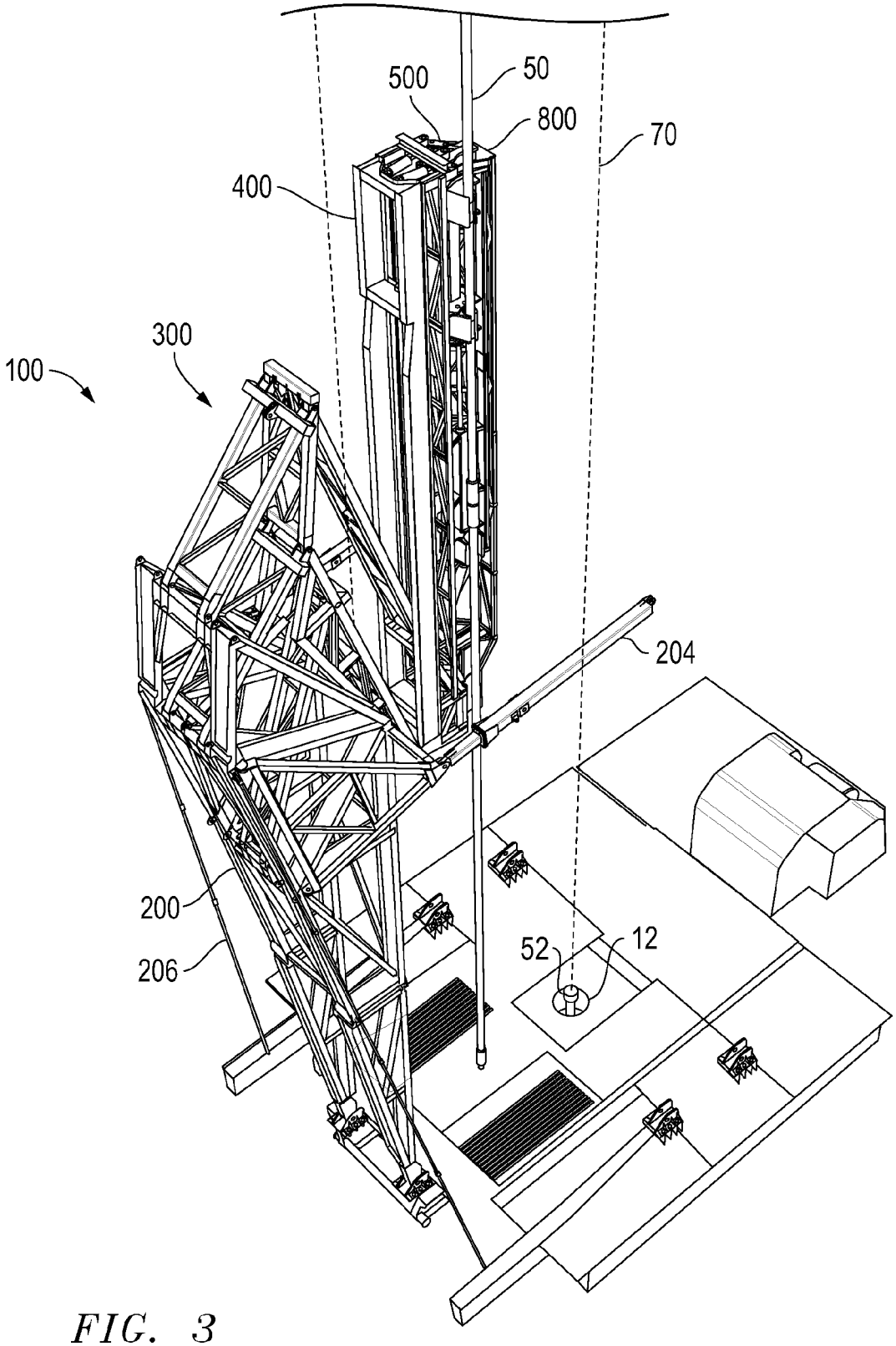
FIG. 3 is an isometric view of the racking mechanism illustrating the lateral extend mechanism partially deployed.
Figure 4:
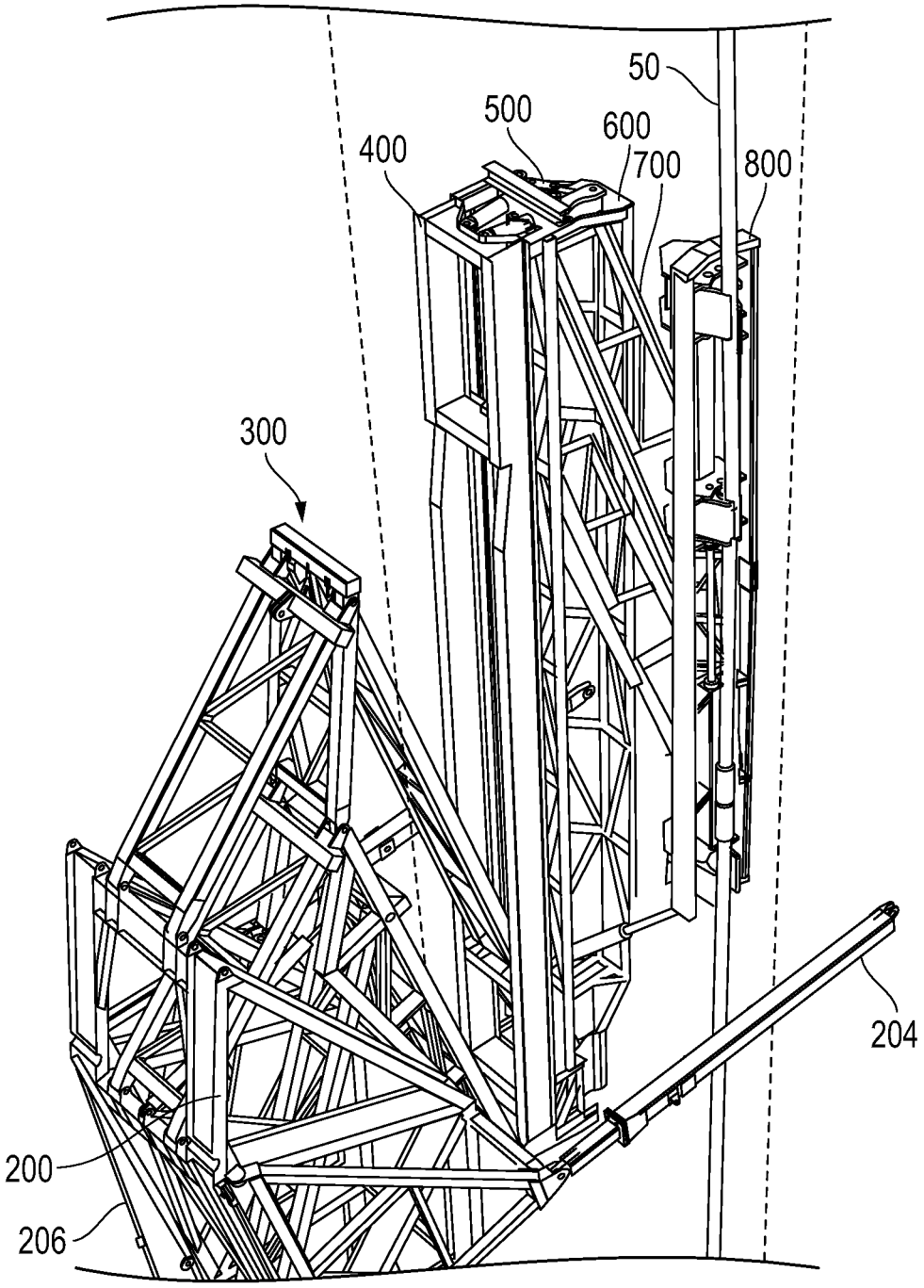
FIG. 4 is an isometric view of the racking mechanism, illustrating the lateral extend mechanism partially deployed, and further illustrating the rotate mechanism rotated 90 (ninety) degrees, and the finger extend mechanism partially deployed, such as in position to receive or to set back a stand of drill pipe in a racking board.

FIG. 3 is an isometric view of racking mechanism 100, illustrating a racking mechanism 100 partially deployed. In FIGS. 3 and 4 , drilling mast 16 of drilling rig 10 has been removed for clarity.

A lateral extend mechanism 300 is pivotally connected to base frame 200. Lateral extend mechanism 300 is extendable between a retracted position substantially within base frame 200, and a deployed position which extends in the direction of well centerline 70. In FIG. 3, as compared to FIG. 2, lateral extend mechanism 300 is partially deployed.

Lateral extend mechanism 300 includes a pivot frame 400. A rotate mechanism 500 is connected to pivot frame 400. A finger extend mechanism 700 (not visible) is connected to rotate mechanism 500. A grip and stab mechanism 800 is connected to rotate mechanism 500. FIG. 3 illustrates rotate mechanism 500 rotated 90 (ninety) degrees, with finger extend mechanism 700 in the retracted position. This position is intermediate of positions for receiving or setting back a stand of drill pipe in racking board 20.

In a preferred embodiment (best seen in FIG. 1), lateral extend mechanism 300 is particularly configured such that upon deployment towards well centerline 70, rotate mechanism 500, finger extend mechanism 700, and grip and stab mechanism 800 are movable to a position beneath racking board 20, and further to a position substantially within drilling mast 16. Also in a preferred embodiment, lateral extend mechanism 300 is particularly configured to be force-balanced, such that upon partial extension, lateral extend mechanism 300 is not inclined to retract or extend, as contrasted to a parallelogram linkage. The benefit of this configuration is that a low pushing force is required to actuate lateral extend mechanism 300 into deployment or retraction.

In another embodiment, racking mechanism 100 is further balanced such that upon failure of the power supply and/or hydraulic pressure, lateral extend mechanism 300 will be slightly more inclined to retract under gravitational force than to extend.

FIG. 4 is an isometric view of racking mechanism 100, illustrating lateral extend mechanism 300 partially deployed, and further illustrating rotate mechanism 500 rotated 90 (ninety) degrees and finger extend mechanism 700 partially deployed. As best seen in FIG. 2, finger extend mechanism 700 (not shown) may be retracted into the interior space of rotate mechanism 500 (not shown) to permit passage through the narrow alley formed between stands of pipe 50 stacked on drill floor 14 when tripping drill pipe 50 out of wellbore 12, such as when changing the drill bit. As contrasted, the position illustrated in FIG. 4 is exemplary of a position for receiving or setting back a stand of drill pipe in racking board 20.

Figure 5:
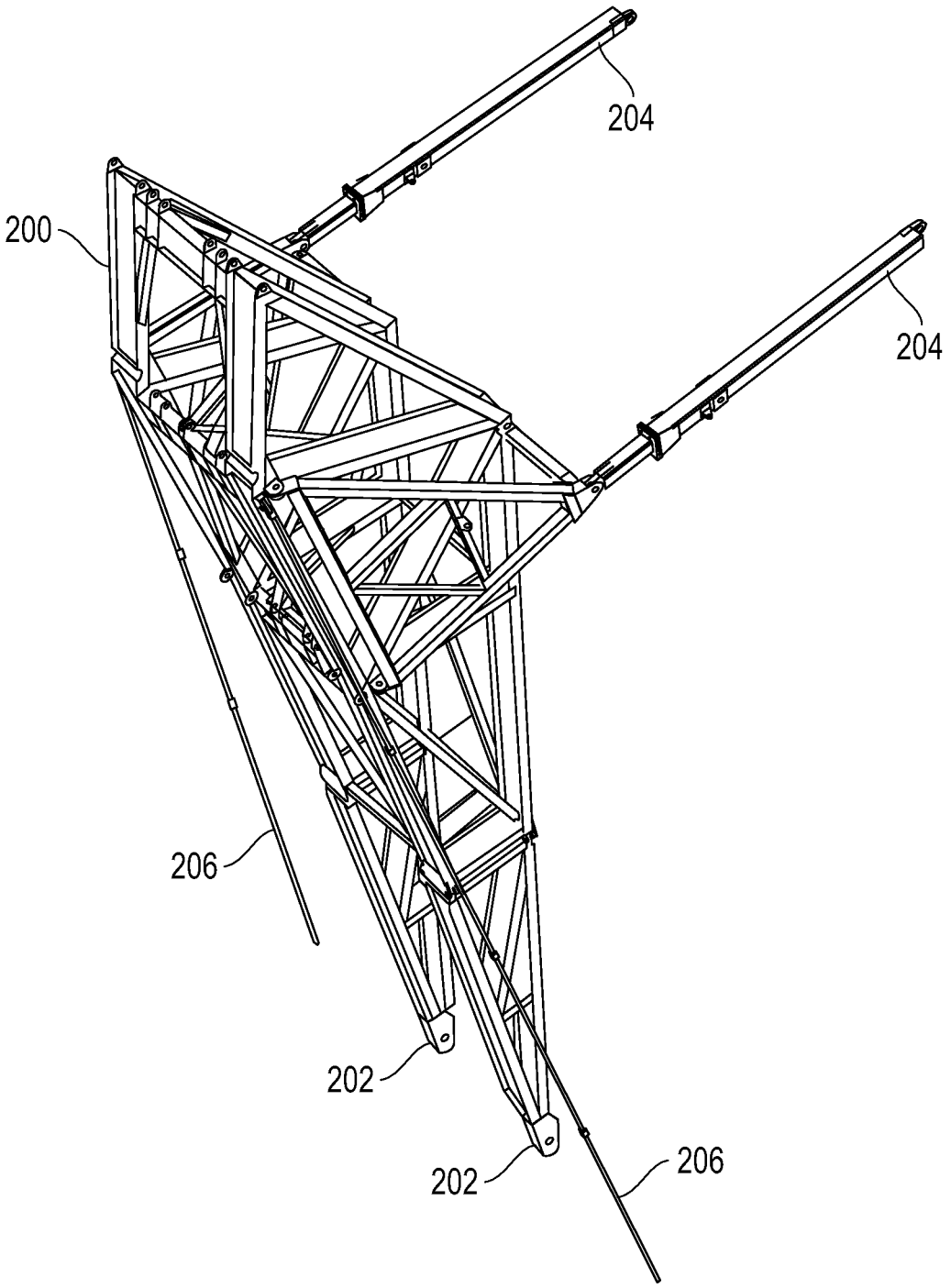
FIG. 5 is an isometric view of the base frame of the racking mechanism illustrating the base frame in isolation of the remaining components of the racking mechanism and of the drilling rig.

FIG. 5 is an isometric view of base frame 200 of racking mechanism 100, illustrating base frame 200 in isolation of the remaining components of racking mechanism 100 and of drilling rig 10. Base frame 200 is pivotally connected to drill floor 14 (not shown) by floor pins 202. A mast brace 204 connects each side of base frame 200 to drilling mast 16 (not shown) of drilling rig 10 (not shown). Mast braces 204 stabilize base frame 200 of racking mechanism 100. In a preferred embodiment, mast braces 204 are adjustable to compensate for verticality of drilling mast 16 and for the variable deflection of racking mechanism 100 when handling different sizes of drill pipe 50.

In another preferred embodiment, a tensioning member 206 connects each side of base frame 200 to drill floor 14 (not shown) of drilling rig 10 (not shown). Tensioning members 206 stabilize base frame 200 of racking mechanism 100. In a preferred embodiment, tensioning members 206 are adjustable to compensate for verticality of racking mechanism 100, and for the variable deflection of racking mechanism 100 when handling different sizes of drill pipe 50.

Figure 6:
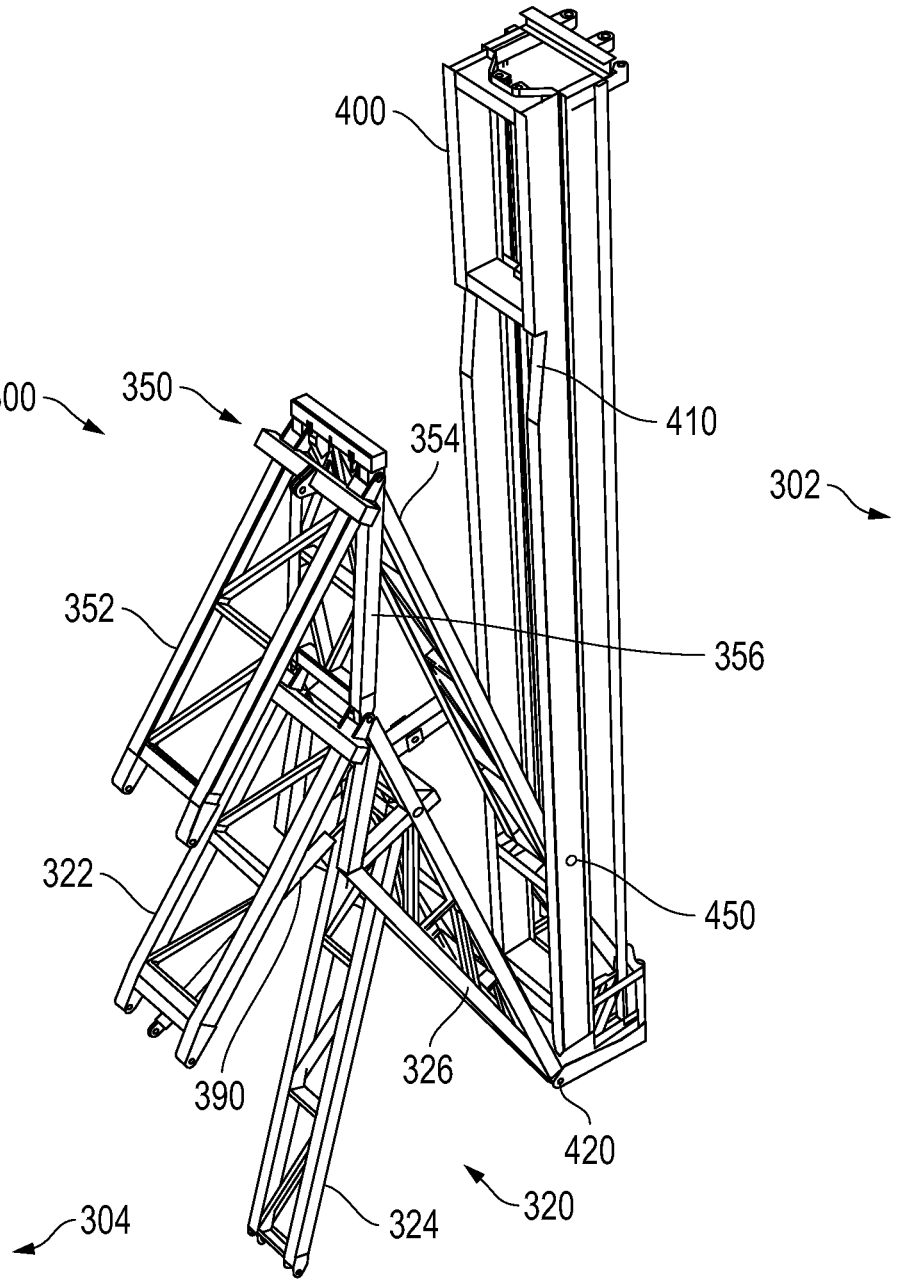
FIG. 6 is an isometric view of the lateral extend mechanism of the racking mechanism illustrating the lateral extend mechanism in isolation of the remaining components of the racking mechanism and of the drilling rig.

FIG. 6 is an isometric view of lateral extend mechanism 300 of FIG. 1, illustrating lateral extend mechanism 300 and pivot frame 400 in isolation of the remaining components of racking mechanism 100 and of drilling rig 10. As shown in FIG. 6, lateral extend mechanism 300 has a mast side 302 and a base connect side 304. Base connect side 304 of lateral extend mechanism 300 is pivotally connected to base frame 200 (not shown). Mast side 302 of lateral extend mechanism 300 is pivotally connected to pivot frame 400 at connections 420 and 450.

In the preferred embodiment illustrated, lateral extend mechanism 300 comprises an extend linkage 320 and level linkage 350. In a more preferred configuration, lateral extend mechanism 300 comprises an eight bar linkage as illustrated.

In the preferred embodiment illustrated, extend linkage 320 is comprised of an upper link 322, a lower link 324, and a long link 326. Also in this embodiment, level linkage 350 is comprised of an inboard link 352, an outboard link 354, and a coupler link 356.

Extend linkage 320 and level linkage 350 are pivotally connected to base frame 200 (not shown) on base connect side 304 via pin connections located at the ends of the extend linkage 320 and level linkage 350. Extend linkage 320 and level linkage 350 are pivotally connected to pivot frame 400 on mast side 302. Extend linkage 320 is pivotally connected to pivot frame 400 at connection 420. Level linkage 350 is pivotally connected to pivot frame 400 at connection 450. Extend linkage 320 and level linkage 350 are also pivotally connected to each other by coupler link 356.

A lateral extend cylinder 390 is pivotally connected between base frame 200 (not shown) and extend linkage 320. Controllable expansion of lateral extend cylinder 390 moves lateral extend mechanism 300 and thus pivot frame 400 between a retracted position substantially internal to base frame 200 (not shown) and an extended position external to base frame 200. In a preferred embodiment, inboard link 352 and upper link 322 are substantially the same length. The novel kinematic configuration of extend linkage 320 and level linkage 350 generates extension of pivot frame 400 along a stable and substantially horizontal path above drill floor 14 (not shown) when lateral extend mechanism 300 is deployed.

The lateral extend mechanism 300 is useful for other drilling rig applications in which it is desirable to horizontally translate another apparatus in a self-balancing manner in which maintaining the vertical alignment of the apparatus is desired. Such applications include positioning a gripping or torque device.

As seen in FIG. 6, pivot frame 400 is in the form of a C-frame, with an opening in the direction of mast side 302 for receiving rotate frame 600 (not shown) and its connected contents.

Figure 7:
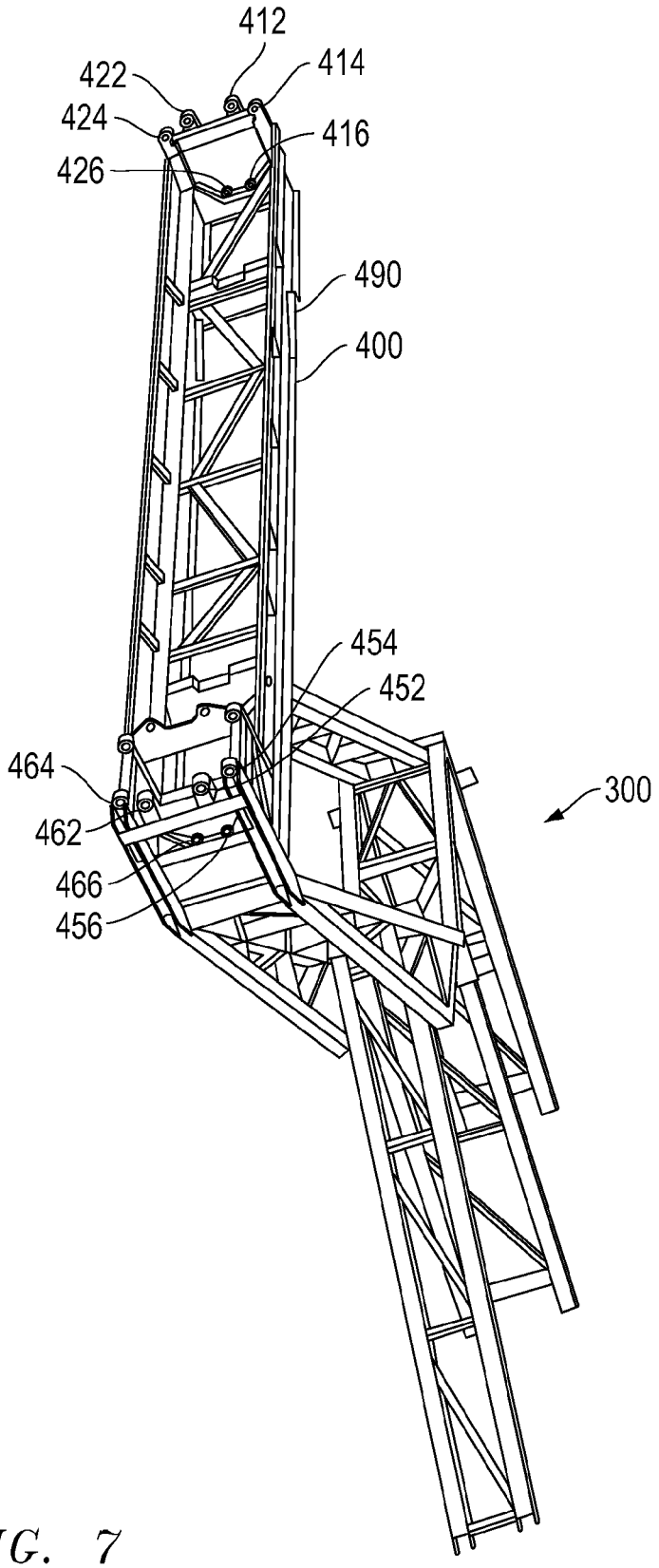
FIG. 7 is an isometric view of the pivot frame illustrated in isolation of the remaining components of the racking mechanism and of the drilling rig.

FIG. 7 is an isometric view of lateral extend mechanism 300 and pivot frame 400 from FIG. 6, shown from the opposite side, with pivot frame 400 in front, and shown from below. Pivot frame 400 has a plurality of sockets for pivotal connection to the linkage of rotate mechanism 500.

In one embodiment as shown, at the top of pivot frame 400 is a right lock socket 412, right drive link socket 414, and a right cylinder socket 416 which are located near the top of pivot frame 400. A left lock socket 422, left drive link socket 424, and a left cylinder socket 426 are also located near the top of pivot frame 400.

A right lock socket 452, right drive link socket 454, and a right cylinder socket 456 are located near the bottom of pivot frame 400, and in respective axial alignment with right lock socket 412, right drive link socket 414, and right cylinder socket 416 at the top of pivot frame 400.

A left lock socket 462, left drive link socket 464, and a left cylinder socket 466 are located near the bottom of pivot frame 400, and in respective axial alignment with left lock socket 422, left drive link socket 424, and left cylinder socket 426 at the top of pivot frame 400.

In one embodiment illustrated in FIG. 7, a notch 490 on pivot frame 400 is receivable of level linkage 350 of lateral extend mechanism 300. A similarly sized notch 410 (not seen) is located on the corresponding side of the pivot frame 400. Engagement of notch 490 (and notch 410) with level linkage 350 stabilizes pivot frame 400 and other components of racking mechanism 100 when lateral extend mechanism 300 is fully retracted.

Figure 8:
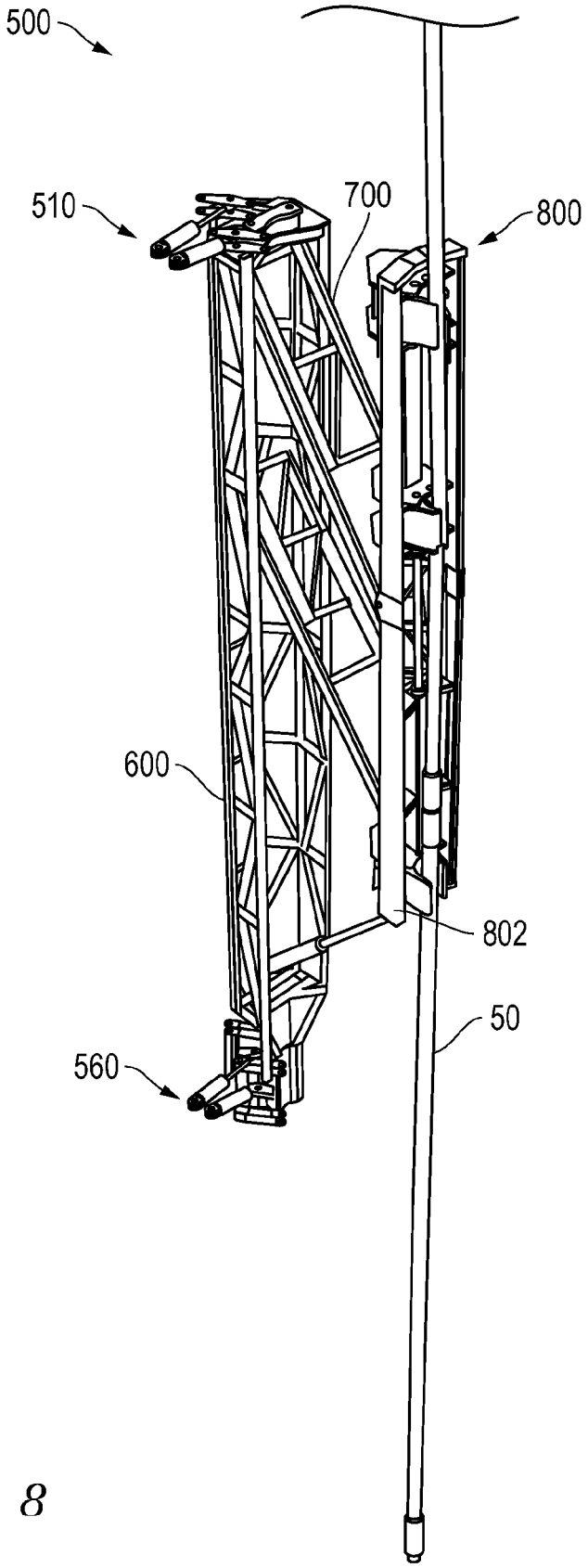
FIG. 8 is an isometric view of the rotate mechanism, finger extend mechanism and grip and stab mechanism of the racking mechanism.

FIG. 8 is an isometric view of the components of racking mechanism 100, illustrating rotate mechanism 500, finger extend mechanism 700, and grip and stab mechanism 800 in isolation of the remaining components of racking mechanism 100 and drilling rig 10. As illustrated in FIG. 8, a rotate mechanism 500 is shown for connection to pivot frame 400. A rotate frame 600 comprises the body of the rotate mechanism 500. A top rotate mechanism 510 and bottom rotate mechanism 560 are also shown connected to the rotate mechanism 500, and used for connection to the pivot frame 400. A finger extend mechanism 700 is connected to rotate mechanism 500. A grip and stab mechanism 800 is connected to rotate mechanism 500 via the finger extend mechanism 700. FIG. 3 illustrates rotate mechanism 500 rotated 90 (ninety) degrees; with finger extend mechanism 700 in the retracted position. This position is intermediate of positions for receiving or setting back a stand of drill pipe in racking board 20.

Figure 9:
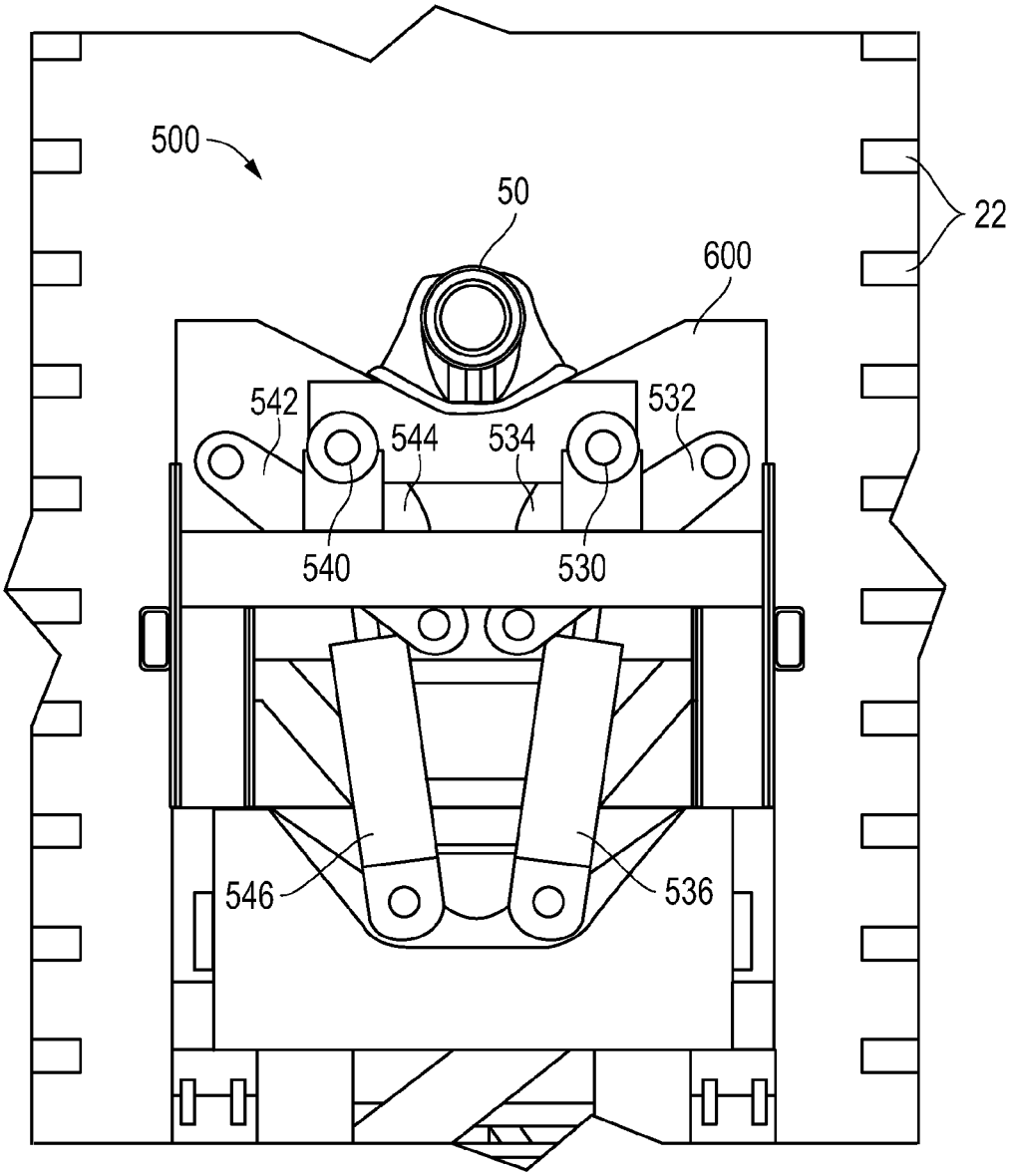
FIG. 9 is a top view of the rotate mechanism illustrating the rotate mechanism in the non-rotated position, and having the finger extend mechanism and grip and stab mechanism retracted.
Figure 10:
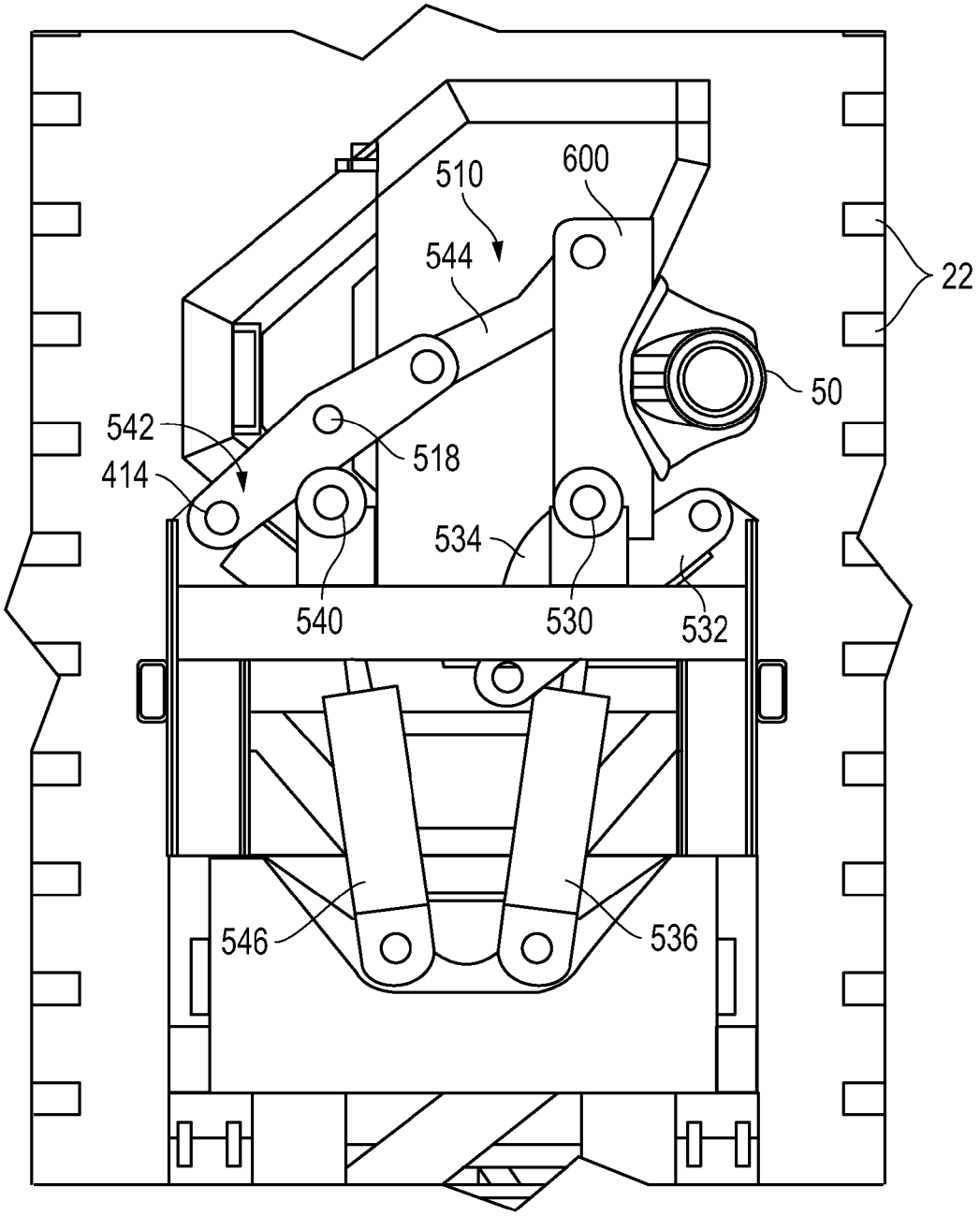
FIG. 10 is a top view of the rotate mechanism illustrating the rotate mechanism rotated 90 (ninety) degrees, and having the finger extend mechanism and grip and stab mechanism retracted.

FIG. 9 is a top view of rotate mechanism 500, illustrating top rotate mechanism 510 in the non-rotated position. FIGS. 9 and 10 illustrate one embodiment in which pivot frame 400 is operably connected to rotate mechanism 500.

As best seen in FIG. 9, top rotate mechanism 500 comprises a right driver 532 pivotally connected to pivot frame 400 at right drive socket 414 (not shown) on one end and pivotally connected to a right coupler 534 on its opposite end. Right coupler 534 is pivotally connected between right driver 532 and rotate frame 600. An expandable right cylinder 536 has one end pivotally connected to pivot frame 400 at right cylinder socket 416 (not shown). The opposite end of right cylinder 536 is pivotally connected to right driver 532 between its connections to pivot frame 400 and right coupler 534. A right rotate lock pin 530 is provided for engagement with pivot frame 400 at right lock socket 412.

As also seen in FIG. 9, top rotate mechanism 500 comprises a left driver 542 pivotally connected to pivot frame 400 at left drive link socket 424 (not shown) on one end and to a left coupler 544 on its opposite end. Left coupler 544 is pivotally connected between left driver 542 and rotate frame 600. An expandable left cylinder 546 has one end pivotally connected to pivot frame 400 at left cylinder socket 426. The opposite end of left cylinder 546 is pivotally connected to left driver 542 between its connections to pivot frame 400 and left coupler 544. A left rotate lock pin 540 is provided for engagement with pivot frame 400 at left lock socket 422 (not shown).

A substantially matching configuration to the linkage and sockets of top rotate mechanism 510 is provided for bottom rotate mechanism 560. In this manner, top rotate mechanism 510 and bottom rotate mechanism 560 work in parallel relation to turn rotate frame 600 of rotate mechanism 500 in the desired direction.

To provide selectable rotation direction, or non-rotated direction, rotate mechanism 500 is connected to pivot frame 400, in part, by selectable rotate lock pins 530 and 540. Rotate frame 600 is clockwise rotatable about a first vertical axis centered on right lock socket 452 of pivot frame 400. Rotate frame 600 is counterclockwise rotatable about a second vertical axis centered on left lock socket 462 of pivot frame 400.

As illustrated in FIG. 9, right rotation of rotate mechanism 500 is caused by actuation of right rotate lock pin 530 into right lock socket 440 (not shown) of pivot frame 400. Subsequent expansion of right cylinder 536 forces right driver 532 to push right coupler 534, which pushes out one end of rotate frame 600. Since the other end of rotate frame 600 is pivotally attached to pivot frame 400 by right rotate lock pin 530 in right lock socket 412, rotate frame 600 rotates to the right.

Similarly, left rotation of rotate mechanism 500 is caused by actuation of left rotate lock pin 540 into left lock socket 422 (not shown) of pivot frame 400. Subsequent expansion of left cylinder 516 forces left driver 542 to push left coupler 544, which pushes out one end of rotate frame 600. Since the other end of rotate frame 600 is pivotally attached to pivot frame 400 by left rotate lock pin 540 in left lock socket 462, rotate frame 600 rotates to the left.

Rotate frame 600 can be locked into non-rotated position by actuation of right rotate lock pin 530 into right lock socket 412 of pivot frame 400, and actuation of left rotate lock pin 540 into left lock socket 422 of pivot frame 400.

As previously stated, the same kinematic relationships are engaged in top rotate mechanism 510 and bottom rotate mechanism 560 so that they may work in parallel relation to turn rotate frame 600 in the desired direction.

FIG. 10 is a top view of rotate mechanism 500 rotated 90 (ninety) degrees to the right. Rotate mechanism 500 comprises a rotate frame 600, a top rotate linkage 510 and a bottom rotate linkage 560 (not shown). Top rotate linkage 510 and bottom rotate linkage 560 pivotally connect rotate frame 600 to pivot frame 400 (not shown). Top rotate linkage 510 and bottom rotate linkage 560 work in parallel relation to turn rotate frame 600 at least 90 (ninety) degrees in a selectable clockwise or counterclockwise direction in relation to pivot frame 400.

Figure 11:
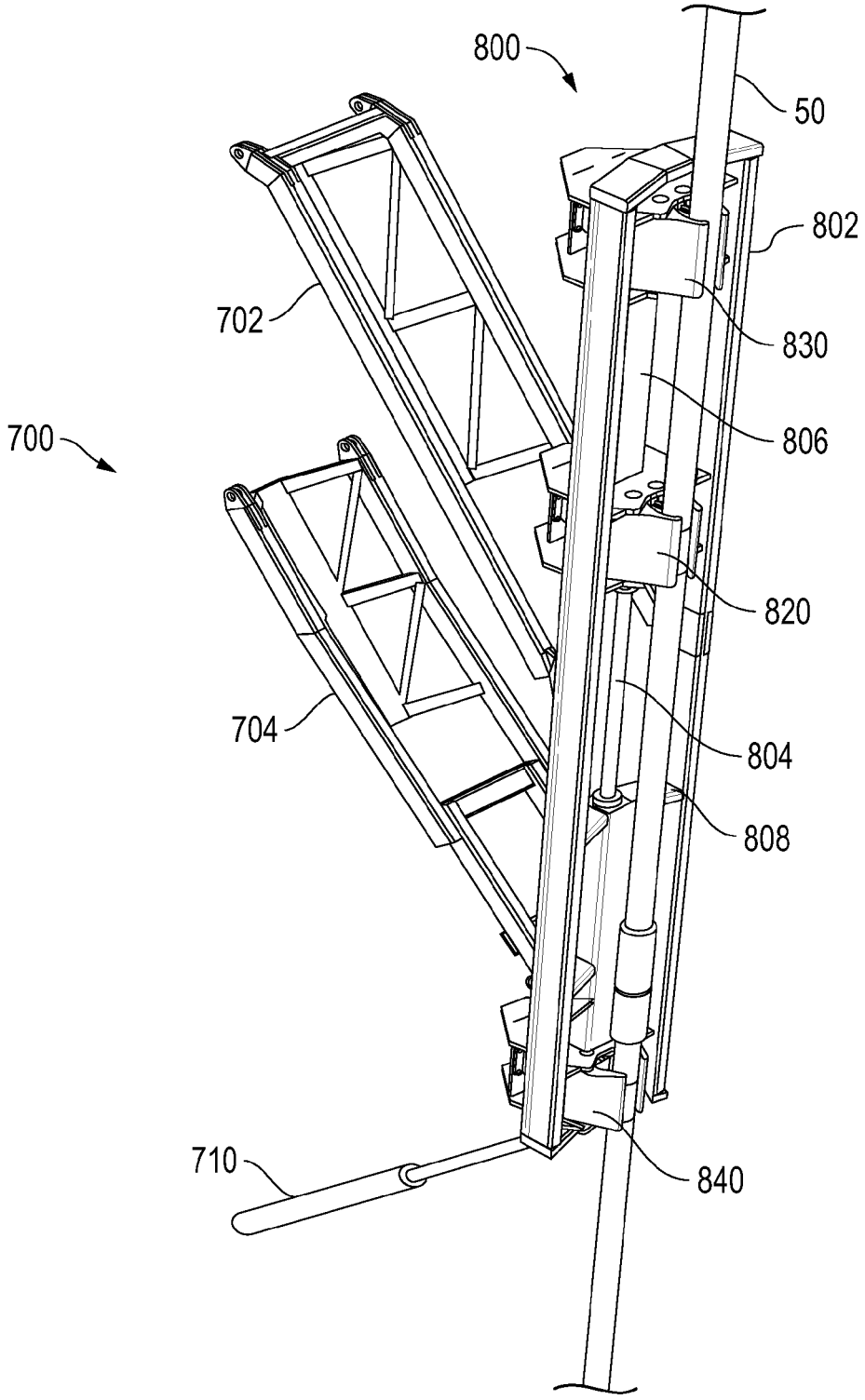
FIG. 11 is an isometric view of the finger extend mechanism and vertical grip and stab mechanism of the racking mechanism.

FIG. 11 is an isometric view of finger extend mechanism 700 and vertical grip and stab mechanism 800. Finger extend mechanism 700 is pivotally connected to rotate frame 600 (not shown). Finger extend mechanism 700 is extendable between a retracted position substantially within rotate frame 600, and a deployed position which extends outward in the selected direction of rotate mechanism 500, away from rotate frame 600. Referring back to FIG. 4, as compared to FIG. 3, finger extend mechanism 700 is partially deployed.

In the preferred embodiment, finger extend mechanism 700 is collapsible within rotate frame 600 such that rotate frame 600, finger extend mechanism 700 and vertical grip and stab mechanism 800 are collectively 180 degrees rotatable within a 48 inch distance.

Finger extend mechanism 700 includes an upper finger extend frame 702 pivotally connected on its upper end to rotate frame 600 and pivotally connected on its lower end to a vertical stab frame 802 of vertical grip and stab mechanism 800. Finger extend mechanism 700 includes a lower finger extend frame 704 pivotally connected on its upper end to rotate frame 600 and pivotally connected on its lower end to vertical stab frame 802. A finger extend cylinder 710 is pivotally connected on a first end to vertical stab frame 802, and connected on a second end to rotate mechanism 500. Extension of finger extend cylinder 710 causes extension of finger extend mechanism 700 and movement of vertical grip and stab mechanism 800 away from rotate frame 500 to position pipe 50 in the desired position.

As stated, vertical grip and stab mechanism 800 has a vertical stab frame 802. Vertical stab frame 802 has a lower end and an opposite upper end. A stab cylinder 804 is located on vertical stab frame 802.

A lower load gripper 820 is mounted in vertically translatable relation to vertical stab frame 802. A spacer 806 is attached above lower load gripper 820. An upper load gripper 830 is mounted above spacer 806, in vertically translatable relation to vertical stab frame 802. Load grippers 820 and 830 are capable of clamping onto the exterior of a drilling tubular and supporting the load of the tubular. Extension of stab cylinder 804 moves lower load gripper 820, spacer 806, and upper load gripper 830 vertically upwards in relation to vertical stab frame 802.

A spring assembly 808 is located between stab cylinder 804 and centering gripper 840. Spring assembly 808 is preloaded with the weight of the lower load gripper 820 and upper load gripper 830. The spring is further loaded when lower load gripper 820 and upper load gripper 830 are used to grip pipe 50, and stab cylinder 804 is extended. This reduces the power required for extending stab cylinder 804 to raise pipe 50. In one embodiment, spring assembly 808 is designed to achieve maximum compression under a weight of approximately 2,000 pounds, which is approximately the weight of a standard drill string.

Preloading spring assembly 808 allows for a gradual load transfer of the vertical forces from stab cylinder 804 to the target support of pipe 50, being either a receiving toll joint of drill pipe stump 52 located in wellbore 12, or on drill floor 14 for setting back the stand of drill pipe 50.

A centering gripper 840 is located on the lower end of vertical stab frame 802. Centering gripper 840 stabilizes pipe 50, while allowing it to translate vertically through its centering grip.

In an alternative embodiment (not illustrated), a gripper assembly is mounted in vertically translatable relation to vertical stab frame 802. At least one load gripper 830 is mounted on the gripper assembly. In this embodiment, extension of stab cylinder 804 moves the gripper assembly, including load gripper 830, vertically upwards in relation to vertical stab frame 802.

FIGS. 12-22 are top views illustrating the operation of racking mechanism 100 moving from a fully retracted position to retrieve a stand of pipe 50 (or other tubular) from pipe rack 20, and delivering pipe stand 50 into alignment for vertical stabbing into drill pipe stump 52 located over wellbore 12. In each of FIGS. 12-22, substantial structure has been removed for the purpose of more clearly illustrating the operation of racking mechanism 100, emphasizing the relationship between racking mechanism 100, pipe rack 20, pipe stand 50, and drill pipe stump 52.

Figure 12:
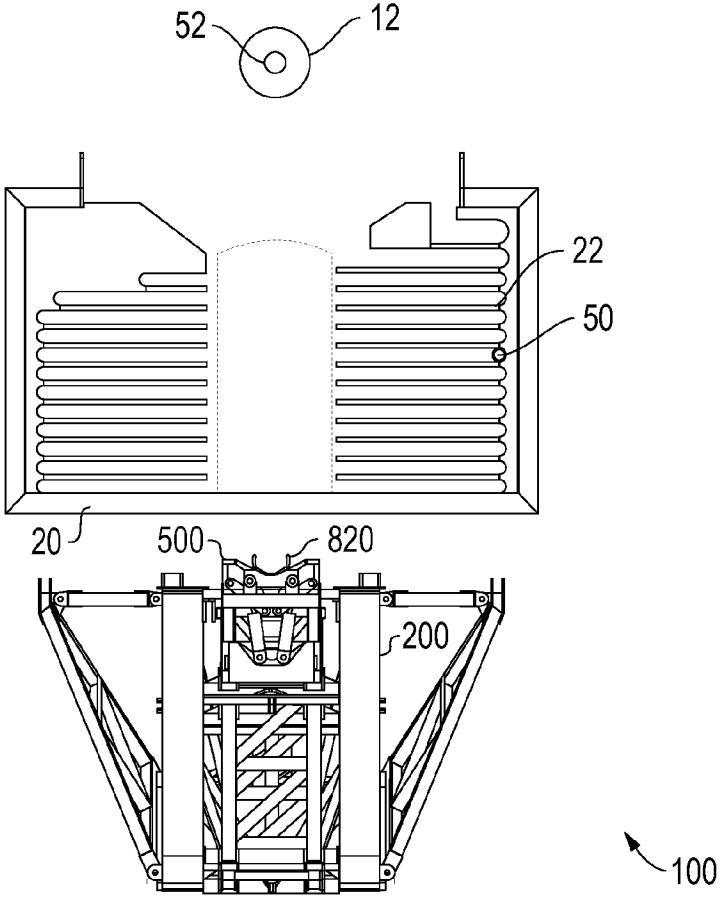

In FIG. 12, racking mechanism 100 is illustrated in the fully retracted position. In this position, the lateral extend mechanism 300 (not seen), rotate mechanism 500, finger extend mechanism 700, and grip and stab mechanism 800 are all fully retracted. In this position, racking mechanism 100 can be serviced. Rotate mechanism 500 can also be rotated and lateral extend mechanism 300 can be extended to permit racking mechanism 100 to be used to lift other drilling rig equipment. It is possible to replace grip and stab mechanism 800 with an alternative gripping device for this purpose.

Figure 13:
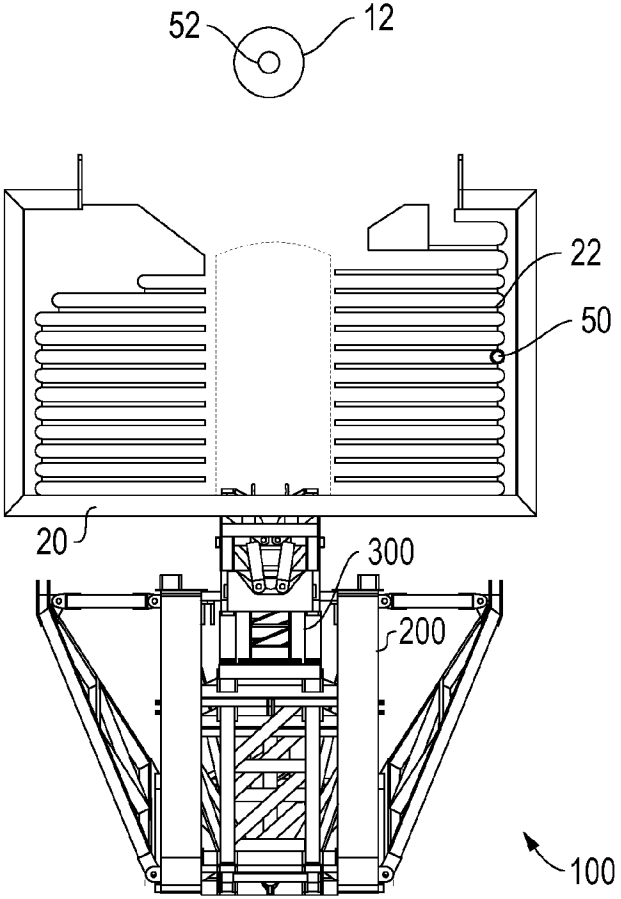
FIGS. 12 through 22 are top views illustrating operation of the automatic pipe racker and illustrating the automatic pipe racker moving from a fully retracted position to retrieve a stand of pipe (or other tubular) from the pipe rack to an extended position and delivering the pipe stand into alignment for vertical stabbing into the stump over the wellbore.

FIG. 13 illustrates racking mechanism 100 having lateral extend mechanism 300 partially extended. In this position, racking mechanism 100 can be parked for immediate access to pipe 50 in racking board 20 when needed.

Figure 14:
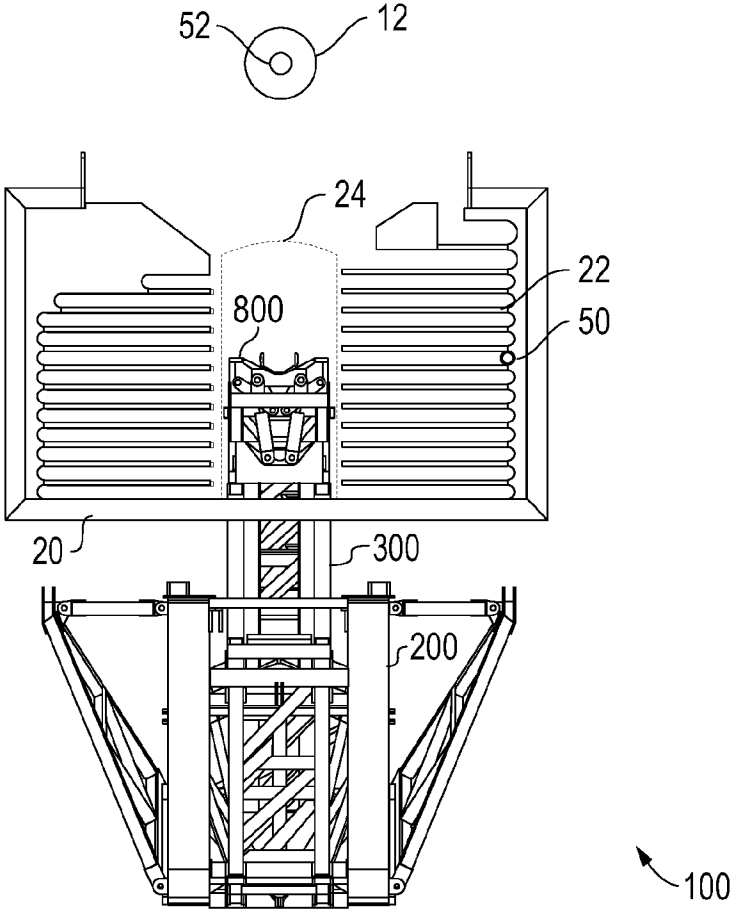

FIG. 14 illustrates racking mechanism 100 in a partially extended position as racking mechanism 100 progresses towards pipe 50 which is resting in racking board 20. In this position, the lateral extend mechanism 300 is partially extended and rotate mechanism 500, finger extend mechanism 700, and grip and stab mechanism 800 are extended to a position beneath a diving board 24.

Figure 15:
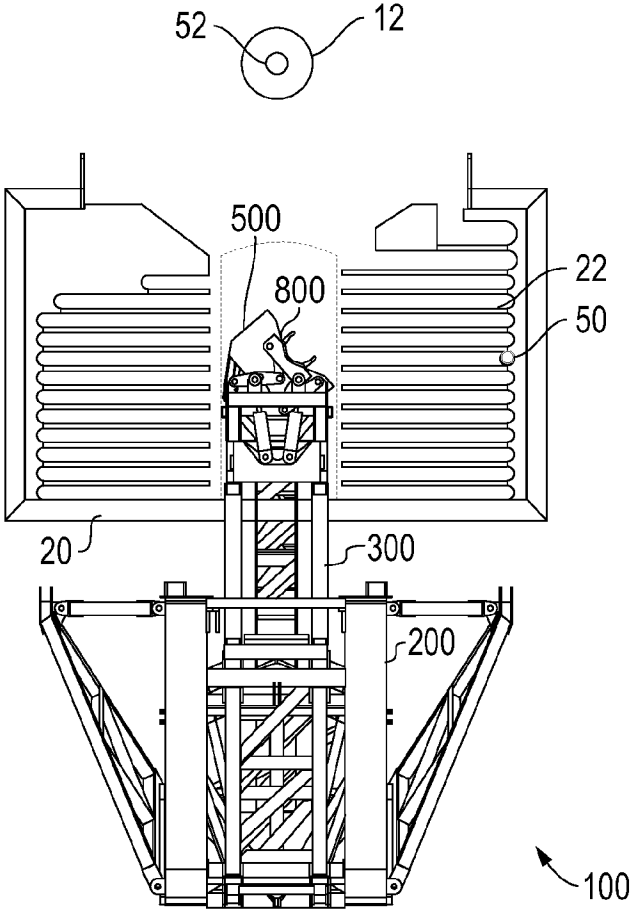

FIG. 15 illustrates racking mechanism 100 with rotate mechanism 500 partially rotated to the right towards pipe 50.

Figure 16:
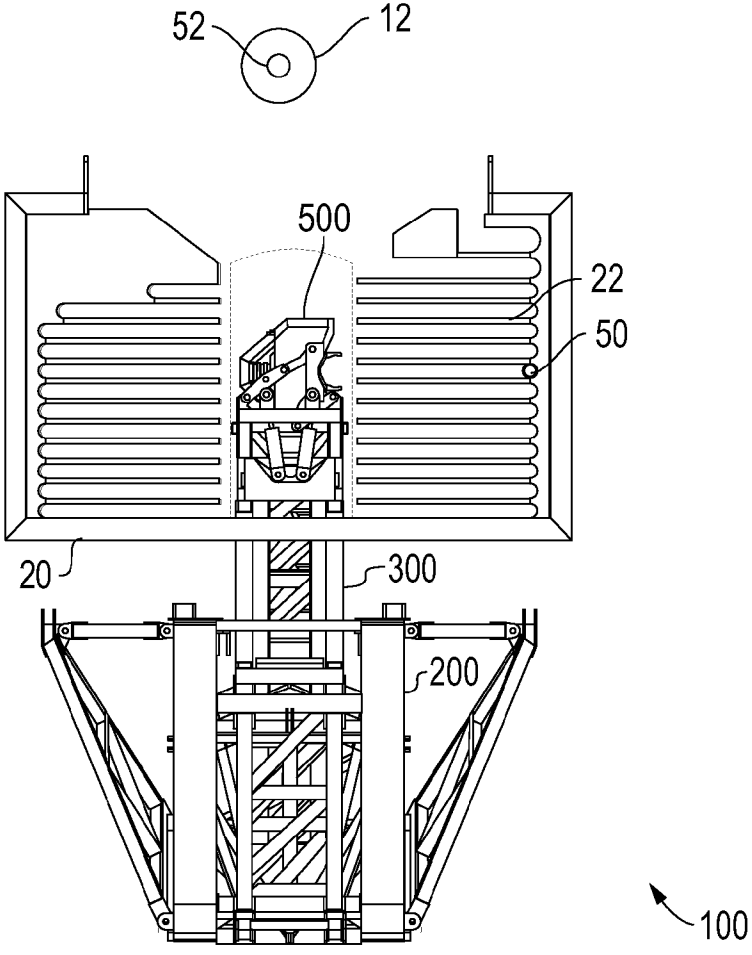

FIG. 16 illustrates rotate mechanism 500 rotated 90 (ninety) degrees and now orienting grip and stab mechanism 800 such that grippers 820, 830, and 840 are open and facing pipe 50.

Figure 17:
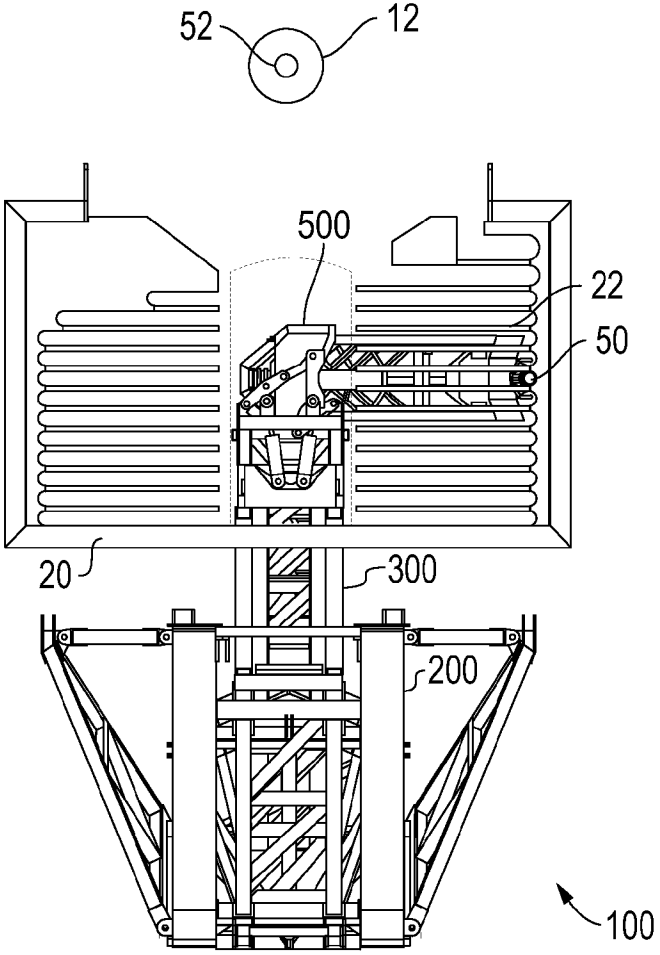

FIG. 17 illustrates racking mechanism 100 having finger extend mechanism 700 fully extended to position grip and stab mechanism 800 adjacent to pipe 50. Grippers 820, 830, and 840 are closed around pipe 50. Stab cylinder 804 is extended and pipe 50 is raised off of drilling floor 10, suspended vertically by upper load gripper 830 and lower load gripper 820. Centering gripper 840 resists undesirable bending and oscillation of pipe 50.

Figure 18:
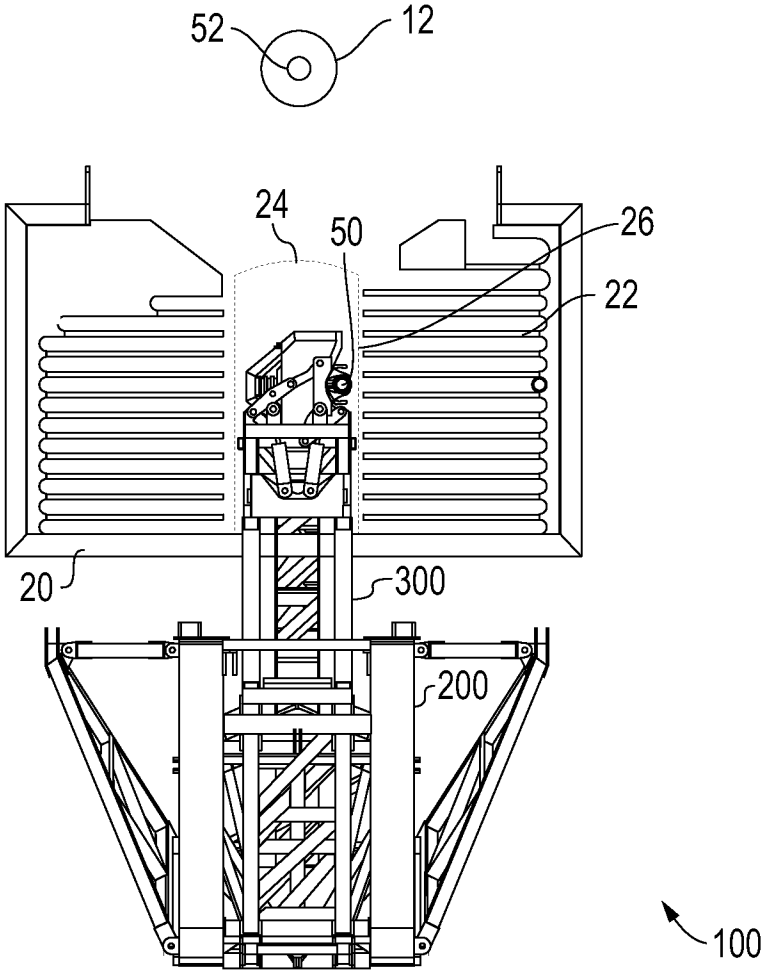

FIG. 18 illustrates racking mechanism 100 having finger extend mechanism 700 retracted to position pipe 50 between diving board 24 and the ends of fingers 22 of racking board 20. Rotate mechanism 500 remains rotated clockwise. A corridor 26 is formed in this space through which pipe 50 must be navigated to avoid conflict with the structure of racking board 20.

Figure 19:
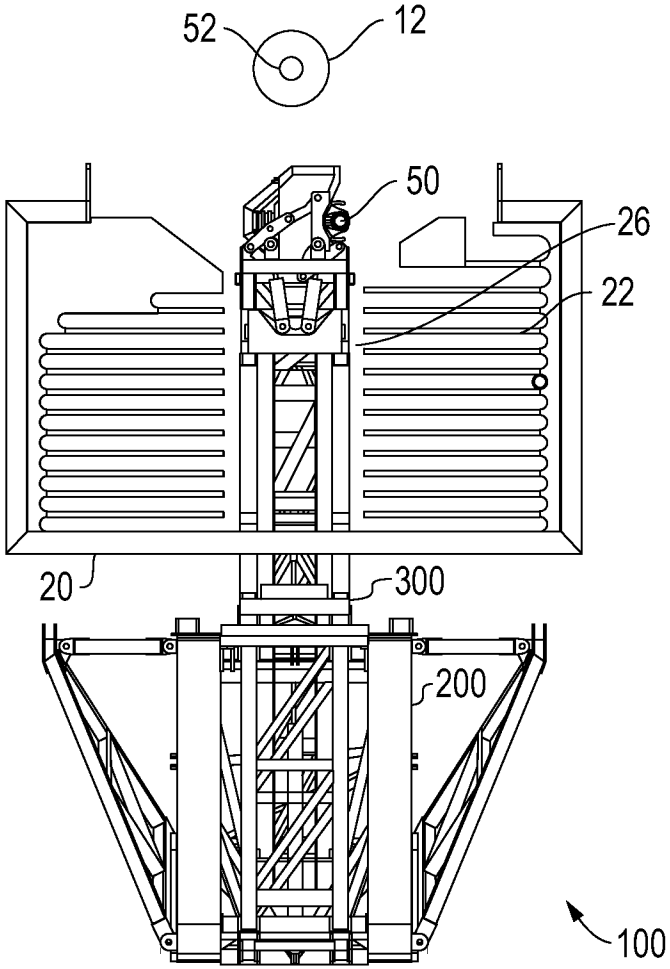

FIG. 19 illustrates racking mechanism 100 having the lateral extend mechanism 300 further extended to guide pipe 50 through corridor 26 towards drill pipe stump 52 in wellbore 12.

Figure 20:
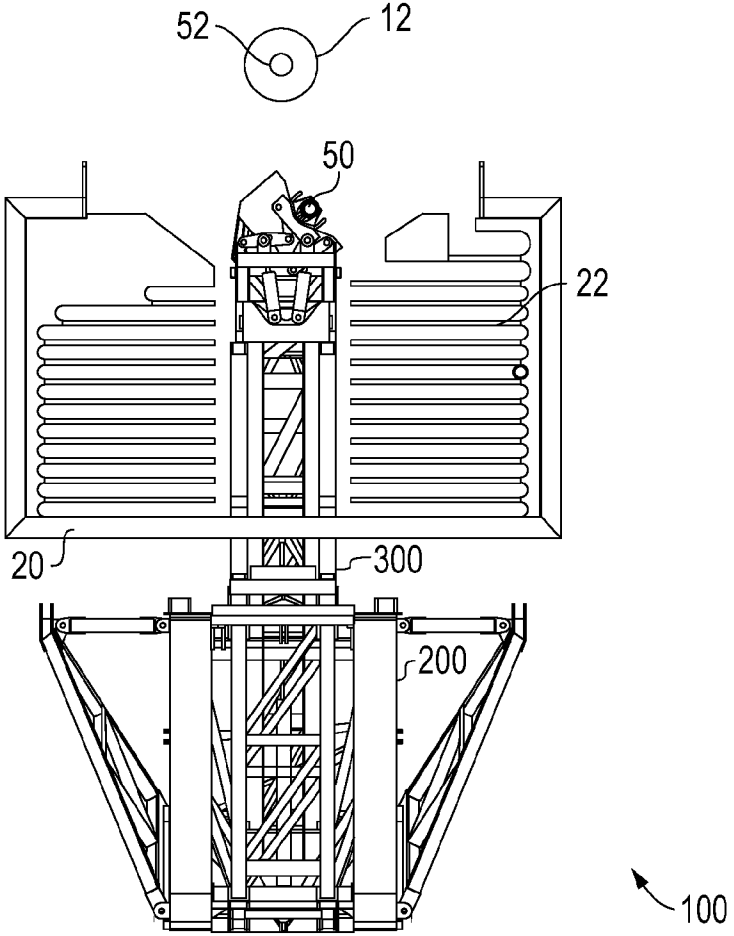

FIG. 20 illustrates racking mechanism 100 having delivered pipe 50 along a substantially horizontal path by the extension of lateral extend mechanism 300. In this position, pipe 50 is now past diving board 24 in the direction of wellbore 12. Rotate mechanism 500 is now being rotated counterclockwise to position pipe 50 in alignment with drill pipe stump 52 in wellbore 12.

Figure 21:
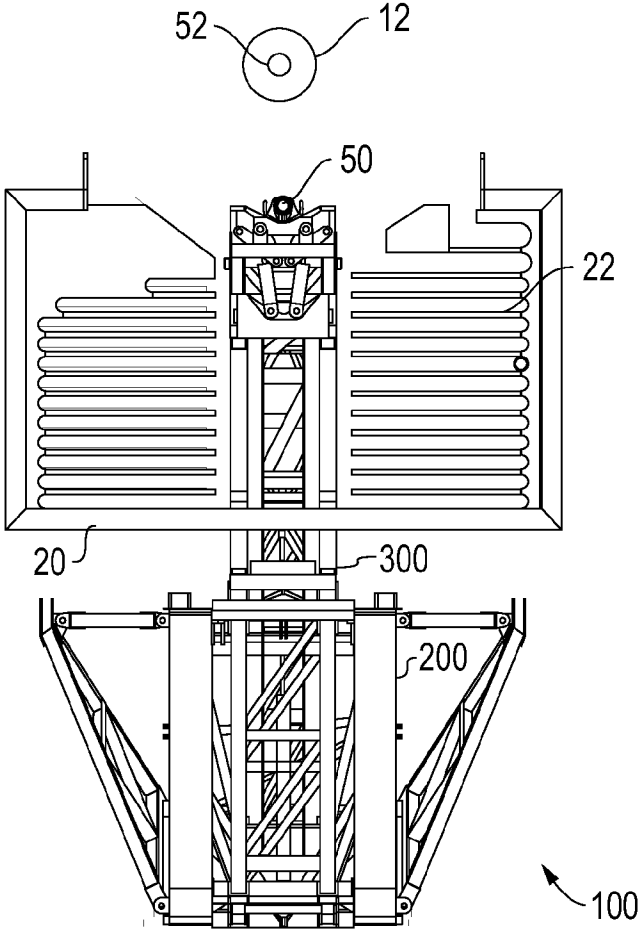

FIG. 21 illustrates racking mechanism 100 having rotate mechanism 500 returned to the forward and non-rotated position, thus aligning pipe 50 for delivery to a position directly above drill pipe stump 52. It is possible to simultaneously actuate rotate mechanism 500 while lateral extend mechanism 300 continues to extend in the direction of drill pipe stump 52 in wellbore 12 to save delivery time.

Figure 22:
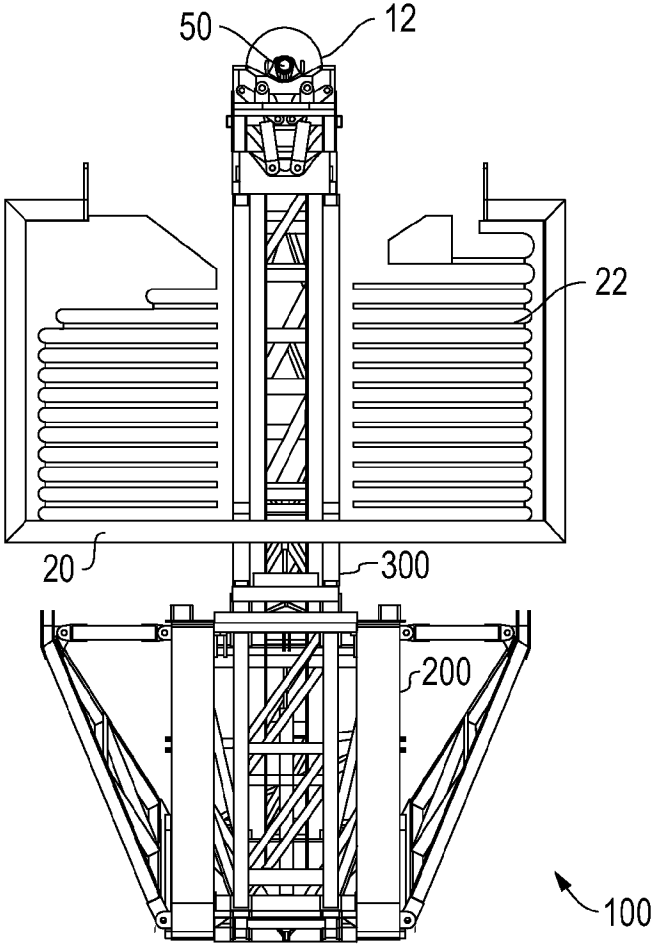

FIG. 22 illustrates racking mechanism 100 having delivered pipe 50 in a vertical position directly above drill pipe stump 52 in wellbore 12. In this position, stab cylinder 804 of grip and stab mechanism 800 is lowered to vertically lower upper load gripper 830 and lower load gripper 820, and thus pipe 50, until the male pin connection of pipe 50 (or other tubular) engages female box connection of drill pipe stump 52. In this position, pipe 50 may be fully connected by rotation and the proper torque into drill pipe stump 52.

FIGS. 23-26 are selected side views of the racking mechanism 100 that correspond to the top views provided in FIGS. 12-22.

Figure 23:
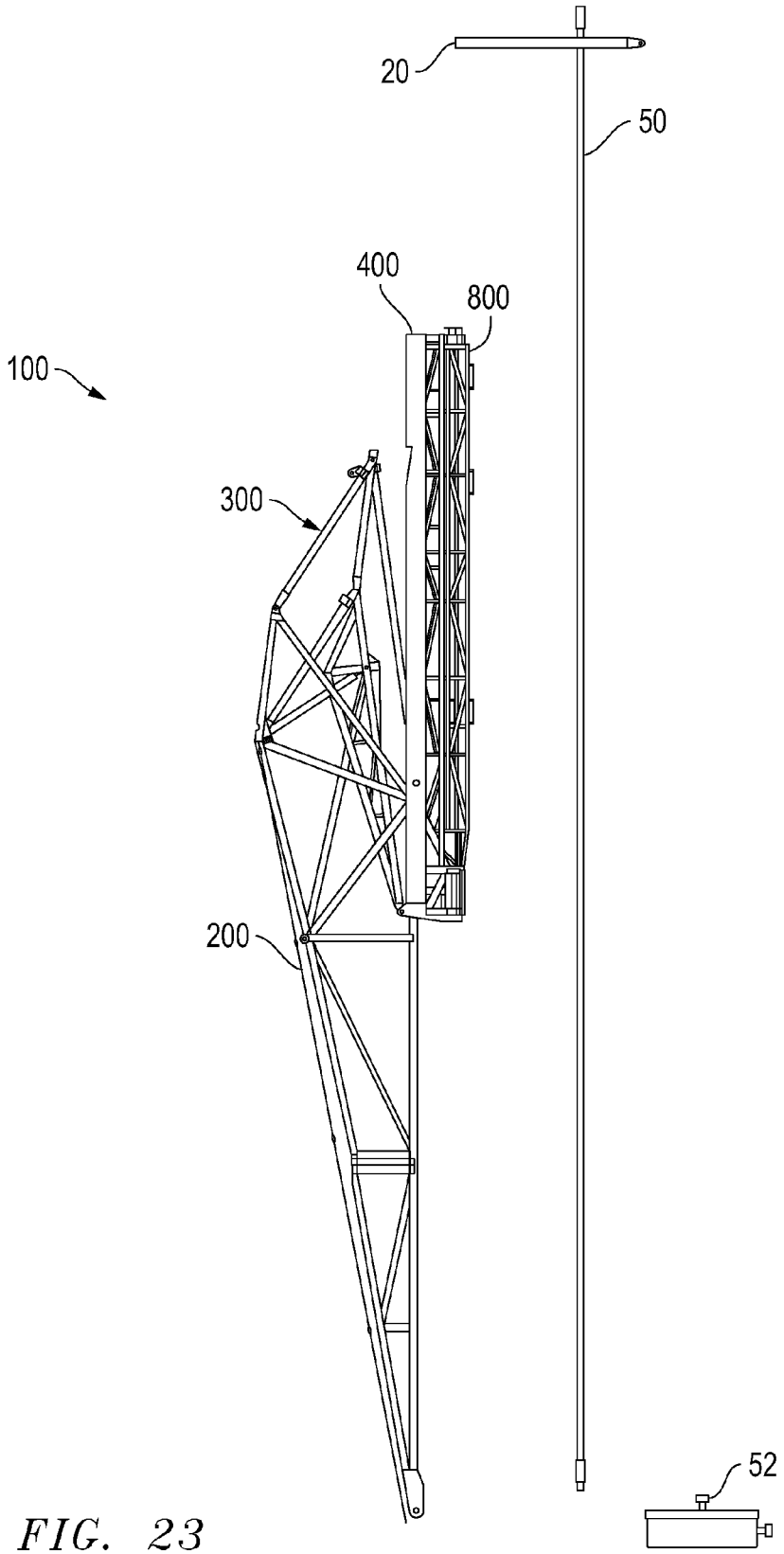
FIG. 23 is a side view of the automatic pipe racking mechanism 100 in the position illustrated in the top view of FIG. 13.

FIG. 23 is a side view of racking mechanism 100 in the position illustrated in the top view of FIG. 13. In this view, racking mechanism 100 is mostly retracted.

Figure 24:
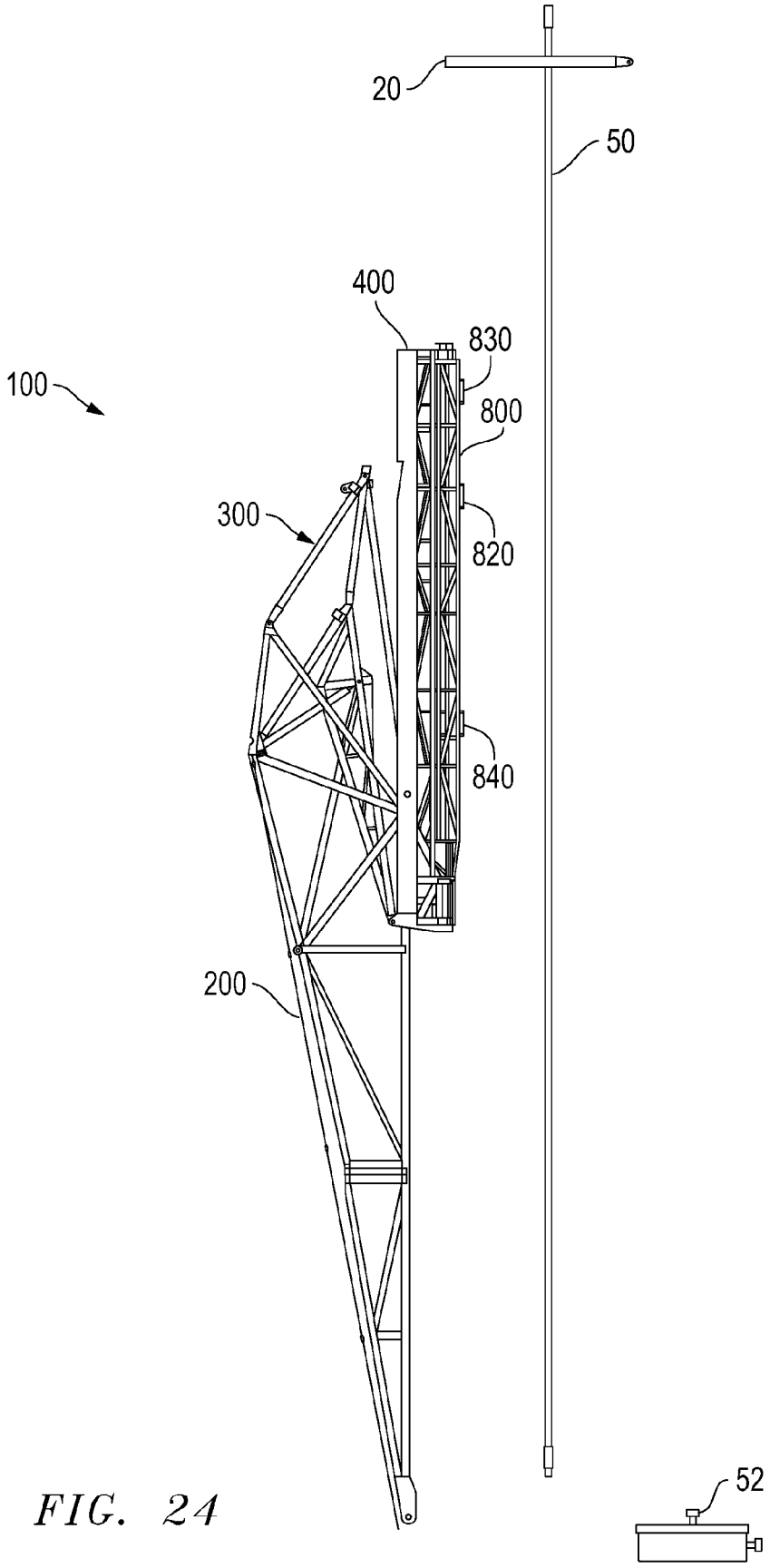
FIG. 24 is a side view of the automatic pipe racking mechanism 100 in the position illustrated in the top view of FIG. 15.

FIG. 24 is a side view of racking mechanism 100 in the position illustrated in the top view of FIG. 15. In this view, lateral extend mechanism 300 is partially extended in the direction of pipe 50, and rotate mechanism 500 is partially rotating to the right towards pipe 50.

Figure 25:
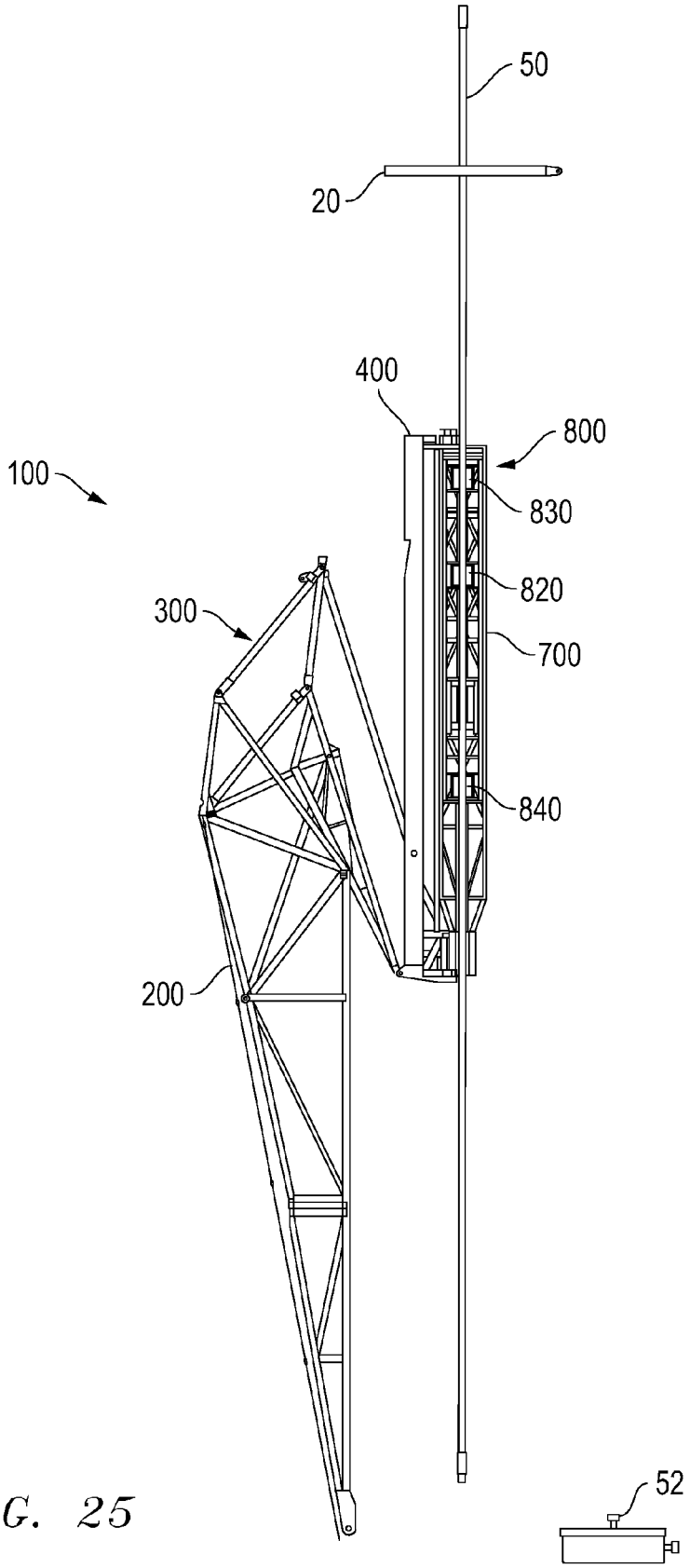
FIG. 25 is a side view of the automatic pipe racking mechanism 100 in the position illustrated in the top view of FIG. 17.

FIG. 25 is a side view of racking mechanism 100 in the position illustrated in the top view of FIG. 17, in which racking mechanism 100 has finger extend mechanism 700 fully extended to position grip and stab mechanism 800 adjacent to pipe 50. Grippers 820, 830, and 840 are closed around pipe 50. Stab cylinder 804 is extended and pipe 50 is raised off of drilling floor 14, suspended vertically by upper load gripper 830 and lower load gripper 820. Centering gripper 840 resists undesirable bending and oscillation of pipe 50.

Figure 26:
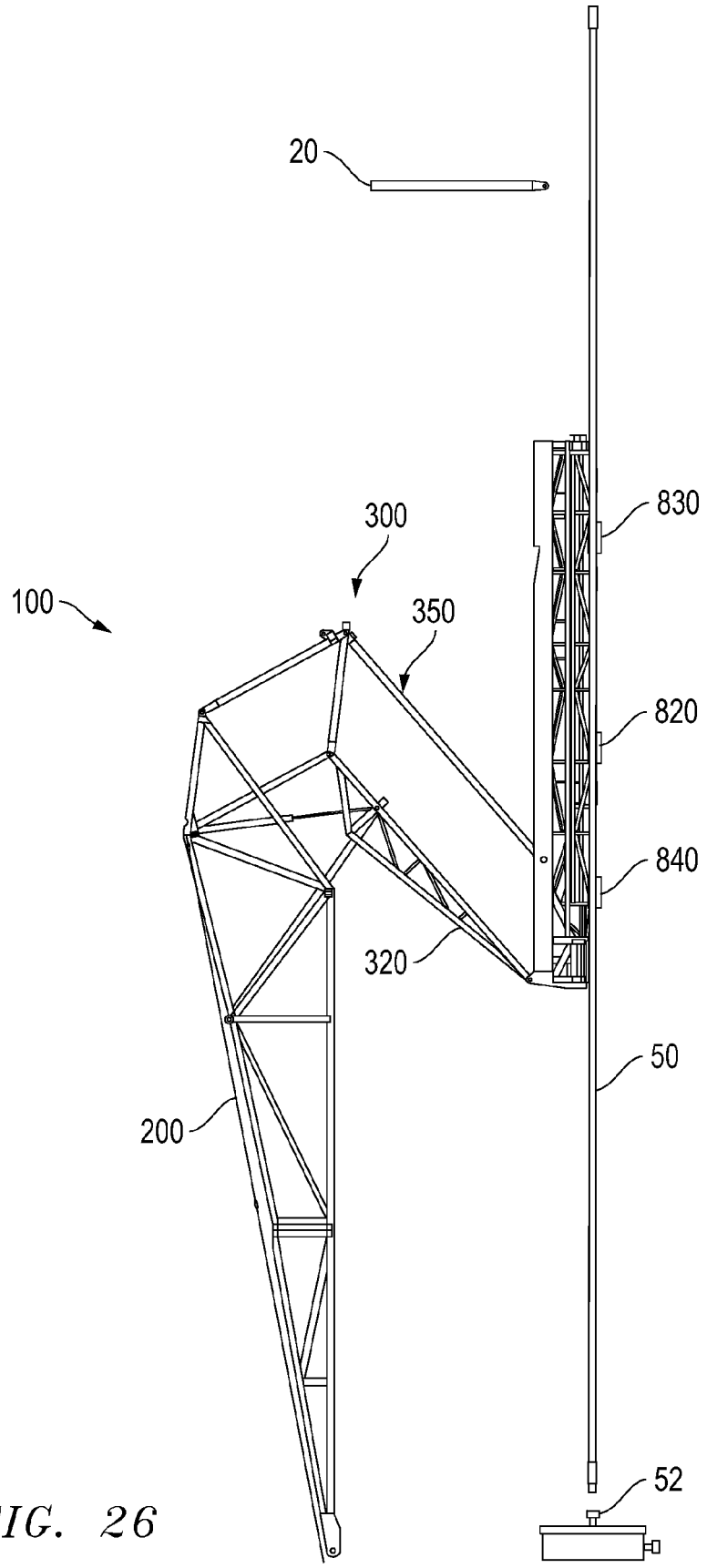
FIG. 26 is a side view of the automatic pipe racking mechanism 100 in the position illustrated in the top view of FIG. 22.

FIG. 26 is a side view of racking mechanism 100 in the position illustrated in the top view of FIG. 22, in which automatic pipe racking mechanism 100 has delivered pipe 50 in a vertical position directly above stump 52 in wellbore 12. In this position, stab cylinder 804 of grip and stab mechanism 800 is lowered to vertically lower upper load gripper 830 and lower load gripper 820, and thus pipe 50, until the male pin connection of pipe 50 (or other tubular) engages female box connection of drill pip stump 52. In this position, pipe 50 may be fully connected by rotation and the proper torque into drill pipe stump 52.

As described, the relationship of these elements has been shown to be extremely advantageous in providing an automatic pipe racking device 100 that can be mounted to a conventional drill floor, and that is capable of lifting and moving drill pipe between a racked position within a largely conventional racking board and a stabbed position over a wellbore.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. An automated pipe racker, comprising:

a base frame connectable to a drill floor of a drill rig and extending upwards at a position offset to a V-door side of a drilling mast that is also connected to the drill floor;

a lateral extend mechanism pivotally connectable to the base frame, the lateral extend mechanism being extendable between a retracted position and a deployed position;

a rotate mechanism connected to the lateral extend mechanism, the rotate mechanism being rotatable in each of a left and right direction;

a finger extend mechanism connected to the rotate mechanism, the finger extend mechanism being laterally extendable between a retracted position and a deployed position;

a grip and stab mechanism attached to the finger extend mechanism, the grip and stab mechanism having grippers for holding a tubular pipe; and, the lateral extend mechanism being deployable to move the rotate mechanism, finger extend mechanism, and grip and stab mechanism between a position beneath a racking board cantilevered from the drilling mast and a position substantially beneath the drilling mast.

2. The automated pipe racker of claim 1, further comprising:

movement of the lateral extend mechanism between the retracted position and the deployed position moves the rotate mechanism along a substantially linear path.

3. The automated pipe racker of claim 1, further comprising:

movement of the lateral extend mechanism between the retracted position and the deployed position moves the rotate mechanism along a substantially horizontal path.

4. The automated pipe racker of claim 1, further comprising:

the rotate mechanism being rotatable in each of a left and right direction at least eighty degrees.

5. The automated pipe racker of claim 1, further comprising:

the grip and stab mechanism being vertically translatable to vertically raise and lower a tubular pipe.

6. An automated pipe racker, comprising:

a base frame connectable to a drill floor of a drill rig and extending upwards at a position offset to a V-door side of a drilling mast that is also connected to the drill floor;

a lateral extend mechanism having a mast side and an opposite base connect side, the base connect side being pivotally connected to the base frame, the mast side being pivotally connected to a pivot frame, the lateral extend mechanism being movable between a retracted position substantially internal to the base frame and an extended position in the direction of the mast beyond the base frame;

a rotate mechanism rotatably connected to the pivot frame, and having a rotate frame, the rotate frame being clockwise rotatable about a first vertical axis, and counterclockwise rotatable about a second vertical axis, upon selectable actuation of the rotate mechanism;

a finger extend mechanism having a mast side and an opposite frame side pivotally attached to the rotate frame, the finger extend mechanism being movable from a retracted position substantially internal to the rotate frame and an extended position external to the rotate frame; and, a grip and stab mechanism attached to the finger extend mechanism, the grip and stab mechanism having grippers for hold a tubular pipe.

7. An automated pipe racker, comprising:

a racker base frame connectable to a drill floor of a drill rig and extending upwards at a position offset to a V-door side of a drilling mast that is also connected to the drill floor;

a lateral extend mechanism having a mast side and an opposite base connect side, the base connect side being pivotally connected to the base frame, the lateral extend mechanism being movable between a refracted position substantially internal to the base frame and an extended position beyond the base frame;

a pivot frame pivotally connected to the mast side of the lateral extend mechanism, the pivot frame being movable along a substantially horizontal path between a retracted position substantially internal to the base frame and an extended position external to the base frame;

a rotate mechanism connected to the pivot frame;

a rotate frame pivotally connected to the rotate mechanism, the rotate frame being clockwise rotatable about a first vertical axis, and counterclockwise rotatable about a second vertical axis, upon selectable actuation of the rotate mechanism;

a finger extend mechanism having a mast side and an opposite frame side pivotally attached to the rotate frame, the finger extend mechanism being movable from a retracted position substantially internal to the rotate frame and an extended position external to the rotate frame; and, a grip and stab mechanism pivotally connected to the finger extend mechanism, the grip and stab mechanism comprising a vertical stab frame, a load gripper, and a stab cylinder connected between the stab frame and load gripper for moving the load gripper vertically in relation to the stab frame.

8. The automated pipe racker of claim 7, further comprising:

a tensioning member connected between the drilling rig and the base frame.

9. The automated pipe racker of claim 8, further comprising:

the tensioning member being connected to the drill floor of the drilling rig.

10. The automated pipe racker of claim 7, further comprising:

the racker base frame is a tapered C-frame.

11. The automated pipe racker of claim 7, further comprising:

a mast brace connected between the base frame and the drilling mast at a position distal to the drill floor for stabilizing an upper end of the base frame in relationship to the mast.

12. The automated pipe racker of claim 7, the lateral extend mechanism further comprising:

an extend linkage and a level linkage;

the extend linkage being pivotally connected to the base frame, the level linkage, and the pivot frame;

the level linkage being pivotally connected to the base frame, the extend linkage, and the pivot frame;

an expandable alley cylinder pivotally connected between the base frame and the extend linkage; and, controllable expansion of the alley cylinder moves the lateral extend mechanism between a retracted position substantially internal to the base frame and an extended position external to the base frame along a substantially horizontal path.

13. The automated pipe racker of claim 12, the lateral extend mechanism further comprising:

the level linkage comprising an inboard link, an outboard link, and a coupler link;

the extend linkage comprising an upper link, a lower link, and a long link; and, the inboard link and the upper link being substantially the same length.

14. The automated pipe racker of claim 12, the lateral extend mechanism further comprising:

the alley cylinder pivotally connected at one end to the base frame; and, the alley cylinder pivotally connected at its opposite end to an end of the lower link that is connected to the long link.

15. The automated pipe racker of claim 12, the lateral extend mechanism further comprising:

the lateral extend mechanism rotating the pivot frame slightly in the direction of the base frame upon extension of the lateral extend mechanism when the grippers are not supporting the load of a tubular.

16. The automated pipe racker of claim 12, the lateral extend mechanism further comprising:

extension of the lateral extend mechanism in the direction of the mast generating a first path of the pivotal connection between the extend linkage and the pivot frame;

extension of the lateral extend mechanism in the direction of the mast generating a second path of the pivotal connection between the level linkage and the pivot frame; and, the horizontal component of the first path being greater than the horizontal component of the second path over the extension of the lateral extend mechanism in relationship to the second path, when the grippers are not supporting the load of a tubular.

17. The automated pipe racker of claim 12, the lateral extend mechanism further comprising:

the level linkage comprising an inboard link, an outboard link, and a coupler link;

the extend linkage comprising an upper link, a lower link, and a long link;

the inboard link and the upper link being substantially the same length;

a first base pin connection, pivotally connecting the inboard link to the base frame;

a second base pin connection, pivotally connecting the upper link to the base frame;

a third base pin connection, pivotally connecting the lower link to the base frame;

a first alley pin connection, pivotally connecting the inboard link to the coupler link and to the outboard link;

a second alley pin connection, pivotally connecting the outboard link to a base of the pivot frame;

a third alley pin connection, pivotally connecting the upper link to the upper second frame and the upper third frame;

a first transverse pin connection, pivotally connecting the upper link to the long link;

a second transverse pin connection, pivotally connecting the lower link to the long link; and, a third transverse pin connection pivotally connecting the long link to the base of the pivot frame.

18. The automated pipe racker of claim 12, the lateral extend mechanism further comprising:

a first alley pivot connection, connecting the alley cylinder to the base frame;

a second alley pivot connection, connecting the alley cylinder to the long link; and, wherein extension of the alley cylinder causes deployment of the lateral extend mechanism in the direction of the mast.

19. The automated pipe racker of claim 7, the rotate mechanism further comprising:

a top rotate mechanism located at a top end of the pivot frame; and, a bottom rotate mechanism located at a bottom end of the pivot frame.

20. The automated pipe racker of claim 19, each of the top and bottom rotate mechanisms further comprising:

a left driver having a frame end and an opposite free end, the frame end being pivotally connected to the pivot frame;

a left coupler pivotally connected at one end to the free end of the left driver, and pivotally connected at its opposite end to the rotate frame;

a right driver having a frame end and an opposite free end, the frame end being pivotally connected to the pivot frame;

a right coupler pivotally connected at one end to the free end of the right driver, and pivotally connected at its opposite end to the rotate frame;

a left expandable actuator connected between the left driver and the pivot frame, such that expansion of the left actuator rotates the rotate mechanism about its pivotal connection to the pivot frame; and, a right expandable actuator connected between the right driver and the pivot frame, such that expansion of the right actuator rotates the rotate mechanism about its pivotal connection to the pivot frame.

21. The automated pipe racker of claim 19, each of the top and bottom rotate mechanisms further comprising:

the rotate frame having a left pivot point and a right pivot point;

the pivot frame having a left pivot point and a right pivot point;

a retractable left pin for selective pin connection between the left pivot point of the rotate frame and the left pivot point of the pivot frame; and, a retractable right pin for selective pin connection between the right pivot point of the rotate frame and the right pivot point of the pivot frame.

22. The automated pipe racker of claim 19, the bottom rotate mechanism further comprising:

either of the expandable actuators expandable to place its respective driver and coupler in substantially collinear alignment as to the pivot connections between the pivot frame and driver, driver and coupler, and coupler and rotate frame.

23. The automated pipe racker of claim 19, the top rotate mechanism further comprising:

selected left pin connection of the rotate frame to the pivot frame; and, selected right pin connection of the rotate frame to the pivot frame, locking the rotate frame in a non-rotated position relative to the pivot frame.

24. The automated pipe racker of claim 19, the bottom rotate mechanism further comprising:

the right pins and the left pins of the top and bottom rotate mechanisms extensible to lock the rotate mechanism in a non-rotated position.

25. The automated pipe racker of claim 7, the finger extend mechanism further comprising:

an upper frame having an upper end and a lower end, the upper end pivotally attached to the rotate frame, and the lower end pivotally attached to the grip and vertical stab mechanism;

a lower finger frame having an upper end and a lower end, the upper end pivotally attached to the rotate frame, and the lower end pivotally attached to the grip and vertical stab mechanism;

an extendable finger cylinder having a first end and a second end, the first end pivotally connected to the rotate frame, and the second end pivotally connected to the lower finger frame; and, controllable extension of the finger cylinder moves the grip and stab mechanism from a retracted position substantially internal to the rotate frame and an extended position external of the rotate frame.

26. The automated pipe racker of claim 7, the finger extend mechanism further comprising:

an upper frame having an upper end and a lower end, the upper end pivotally attached to the rotate frame, and the lower end pivotally attached to the grip and vertical stab mechanism;

a lower finger frame having an upper end and a lower end, the upper end pivotally attached to the rotate frame, and the lower end pivotally attached to the grip and vertical stab mechanism;

an extendable finger cylinder having a first end and a second end, the first end pivotally connected to the rotate frame, and the second end pivotally connected to the lower finger frame; and, extension of the finger cylinder moves the grip and stab mechanism from a retracted position to an extended position along a substantially horizontal path.

27. The automated pipe racker of claim 7, further comprising:

a vertical stab frame attached to the finger extend mechanism;

the vertical stab frame comprising a lower gripper frame, and an upper gripper frame connected in vertically slidable relation to the lower gripper frame;

a stab cylinder expandable to raise the upper gripper frame in relation to the lower gripper frame;

a load gripper mounted to the upper gripper frame; and, a centralizing gripper mounted onto the lower gripper frame.

28. An automated pipe racker, comprising:

a base frame connectable to a drill floor of a drill rig and extending upwards at a position offset to a V-door side of a drilling mast that is also connected to the drill floor;

a lateral extend mechanism having a mast side and an opposite base connect side, the lateral extend mechanism pivotally connectable to the base frame, the lateral extend mechanism being extendable between a retracted position and a deployed position;

a pivot frame pivotally connected to the mast side of the lateral extend mechanism;

a rotate frame rotatable between a stowed position substantially within the pivot frame, and a fully deployed position substantially external to the pivot frame;

a finger extend mechanism having a mast side and an opposite frame connect side pivotally attached to the rotate frame;

the finger mechanism being movable from a retracted position substantially internal to the rotate frame and an extended position external to the rotate frame; and, a grip and stab mechanism connected to the mast side of the finger extend mechanism, and having a plurality of operable grippers capable of clamping onto the exterior of a drilling tubular, the operable grippers being translatable in a substantially vertical direction.

29. An automated pipe racker, comprising:

a racker base frame securely connectable to a drill floor of a drill rig and extending generally upwards at a distance offset from a drilling mast that is also connected to the drill floor;

a mast brace connected between the base frame and the drilling mast at a position distal to the drill floor for stabilizing the racker base frame;

a lateral extend mechanism having a mast side and an opposite base connect side, the base connect side being pivotally connected to the base frame, and the lateral extend mechanism being movable from a retracted position substantially internal to the base frame and an extended position external to the base frame;

a pivot frame pivotally connected to the mast side of the lateral extend mechanism;

a rotate frame connected to the pivot frame, and rotatable between a stowed position substantially within the pivot frame, and a fully deployed position substantially external to the pivot frame;

a finger extend mechanism having a mast side and an opposite frame connect side pivotally attached to the rotate frame;

the finger extend mechanism being movable from a retracted position substantially internal to the rotate frame and an extended position external to the rotate frame; and, a grip and stab mechanism connected to the mast side of the finger extend mechanism, and having a plurality of operable grippers capable of clamping onto the exterior of a drilling tubular, the operable grippers being movable in a substantially vertical direction.

* * * * *